US009234150B2

(12) United States Patent
Martin et al.

(10) Patent No.: US 9,234,150 B2
(45) **Date of Patent: *Jan. 12, 2016**

(54) LOW VISCOSITY ENGINE OIL COMPOSITIONS

(75) Inventors: Richard Wayne Martin, Woolwich Township, NJ (US); Douglas Edward Deckman, Mullica Hill, NJ (US); Kevin John Kelly, Mullica Hill, NJ (US); Craig Janzen Emett, Houston, TX (US); Mark Paul Hagemeister, Houston, TX (US); Bruce Allan Harrington, Houston, TX (US); Chon-Yie Lin, Houston, TX (US); Phillip Thomas Matsunaga, Houston, TX (US); Charles James Ruff, Houston, TX (US); Kevin Bruce Stavens, Houston, TX (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 617 days.

This patent is subject to a terminal disclaimer.

(21) Appl. No.: 13/611,500

(22) Filed: Sep. 12, 2012

(65) Prior Publication Data

US 2013/0090273 A1 Apr. 11, 2013

Related U.S. Application Data

(60) Provisional application No. 61/545,386, filed on Oct. 10, 2011, provisional application No. 61/545,393, filed on Oct. 10, 2011, provisional application No. 61/545,398, filed on Oct. 10, 2011.

(51) Int. Cl.

| | |
|---|---|
| ***C10M 105/04*** | (2006.01) |
| ***C10M 107/02*** | (2006.01) |
| ***C10M 107/10*** | (2006.01) |
| ***C10M 169/04*** | (2006.01) |
| ***C10M 103/00*** | (2006.01) |
| ***C10M 105/32*** | (2006.01) |
| ***C10M 169/02*** | (2006.01) |
| ***C10M 171/02*** | (2006.01) |
| ***C10M 111/04*** | (2006.01) |

(52) U.S. Cl.

CPC ..... *C10M 105/04* (2013.01); *C10M 3/00* (2013.01); *C10M 105/32* (2013.01); *C10M 107/10* (2013.01); *C10M 111/04* (2013.01); *C10M 169/02* (2013.01); *C10M 169/04* (2013.01); *C10M 171/02* (2013.01); *C10M 2203/1025* (2013.01); *C10M 2203/1065* (2013.01); *C10M 2205/003* (2013.01); *C10M 2205/024* (2013.01); *C10M 2205/0285* (2013.01); *C10M 2205/22* (2013.01); *C10M 2205/223* (2013.01); *C10M 2223/045* (2013.01); *C10N 2210/02* (2013.01); *C10N 2220/028* (2013.01); *C10N 2230/02* (2013.01); *C10N 2230/04* (2013.01); *C10N 2230/10* (2013.01); *C10N 2230/12* (2013.01); *C10N 2230/45* (2013.01); *C10N 2230/52* (2013.01); *C10N 2230/54* (2013.01); *C10N 2230/68* (2013.01); *C10N 2230/74* (2013.01); *C10N 2240/10* (2013.01); *C10N 2270/00* (2013.01)

(58) Field of Classification Search

CPC ..... C10M 105/04; C10M 107/02; C10M 2203/0206; C10M 2205/0206

USPC ..... 585/10, 510; 508/591

See application file for complete search history.

(56) References Cited

U.S. PATENT DOCUMENTS

| | | | | |
|---|---|---|---|---|
| 4,704,491 | A | 11/1987 | Tsutsui et al. | |
| 5,087,788 | A | 2/1992 | Wu | |
| 5,264,642 | A * | 11/1993 | Wu | 585/530 |
| 5,284,988 | A | 2/1994 | Schaerfl, Jr. et al. | |
| 5,688,887 | A | 11/1997 | Bagheri et al. | |
| 5,912,212 | A | 6/1999 | Igarashi et al. | |
| 6,043,401 | A | 3/2000 | Bagheri et al. | |

(Continued)

FOREIGN PATENT DOCUMENTS

| | | | |
|---|---|---|---|
| JP | 2005200454 | A | 7/2005 |
| JP | 2011121991 | A | 6/2011 |

(Continued)

OTHER PUBLICATIONS

A. Onopchenko, "BF3-Catalyzed Oligomerization of Alkenes: Structures, Mechanisms, and Properties", Ind. Eng. Chem. Prod. Res. Dev., 1983, vol. 22, pp. 182-191.

(Continued)

*Primary Examiner* — Ellen McAvoy

(74) *Attorney, Agent, or Firm* — Derek M. Kate; Robert A. Migliorini

(57) ABSTRACT

This invention is directed to ultra-low viscosity passenger car engine oil compositions with a kinematic viscosity at 100° C. of from 4 to 6 cSt, and comprising in admixture 60 wt % to 90 wt % of a first base oil component, based on the total weight of the composition, the first base oil component consisting of a polyalphaolefin base stock or combination of polyalphaolefin base stocks, each having a kinematic viscosity at 100° C. of from 3.2 cSt to 3.8 cSt; and 0.1 wt % to 20 wt % of a second base oil component, based on the total weight of the composition, the second base oil component consisting of a Group II, Group III or Group V base stock, or any combination thereof; wherein the composition comprises from 0 wt % to less than 0.25 wt % viscosity index improver, on a solid polymer basis.

24 Claims, No Drawings

(56) References Cited

U.S. PATENT DOCUMENTS

| | | | | |
|---|---|---|---|---|
| 6,060,437 | A | 5/2000 | Robson et al. | |
| 6,133,209 | A | 10/2000 | Rath et al. | |
| 6,414,090 | B2 | 7/2002 | Minami et al. | |
| 6,414,091 | B2 | 7/2002 | Moritomi et al. | |
| 6,548,723 | B2 | 4/2003 | Bagheri et al. | |
| 6,548,724 | B2 | 4/2003 | Bagheri et al. | |
| 6,680,417 | B2 | 1/2004 | Bagheri et al. | |
| 6,706,828 | B2 | 3/2004 | DiMaio | |
| 6,713,438 | B1 | 3/2004 | Baillargeon et al. | |
| 7,129,197 | B2 * | 10/2006 | Song et al. | 508/591 |
| 7,880,047 | B2 * | 2/2011 | Knowles et al. | 585/523 |
| 8,168,838 | B2 * | 5/2012 | Heilman et al. | 585/18 |
| 8,207,390 | B2 * | 6/2012 | Wu et al. | 585/523 |
| 8,268,762 | B2 * | 9/2012 | Fujita | 508/591 |
| 8,455,416 | B2 * | 6/2013 | Bagheri et al. | 508/591 |
| 8,536,391 | B2 * | 9/2013 | Small et al. | 585/255 |
| 8,637,438 | B2 * | 1/2014 | Yamada | 508/591 |
| 8,962,899 | B2 * | 2/2015 | Takagi et al. | 585/1 |
| 2001/0041818 | A1 | 11/2001 | Bagheri et al. | |
| 2007/0043248 | A1 | 2/2007 | Wu et al. | |
| 2007/0142242 | A1 | 6/2007 | Gleeson et al. | |
| 2008/0146469 | A1 | 6/2008 | Sato et al. | |
| 2009/0005279 | A1 | 1/2009 | Wu et al. | |
| 2009/0036725 | A1 | 2/2009 | Wu et al. | |
| 2009/0093657 | A1 | 4/2009 | Buchanan et al. | |
| 2009/0181872 | A1 | 7/2009 | Yamada | |
| 2009/0221775 | A1 | 9/2009 | Hagemeister et al. | |
| 2009/0240012 | A1 | 9/2009 | Patil et al. | |
| 2009/0247442 | A1 | 10/2009 | Hagemeister et al. | |
| 2009/0305926 | A1 | 12/2009 | Wu et al. | |
| 2010/0062954 | A1 | 3/2010 | Fujita | |
| 2011/0039743 | A1 | 2/2011 | Bagheri et al. | |
| 2011/0137091 | A1 * | 6/2011 | Yang et al. | 585/10 |
| 2011/0195878 | A1 | 8/2011 | Tellier et al. | |
| 2011/0207977 | A1 | 8/2011 | Fujikawa et al. | |

FOREIGN PATENT DOCUMENTS

| | | | |
|---|---|---|---|
| WO | 03020856 | A1 | 3/2003 |
| WO | 2007011832 | A1 | 1/2007 |
| WO | 2008010865 | A1 | 1/2008 |
| WO | 2009017953 | A2 | 2/2009 |
| WO | 2009123800 | A1 | 10/2009 |
| WO | 2011105358 | A1 | 9/2011 |
| WO | 2011125879 | A1 | 10/2011 |
| WO | 2011125880 | A1 | 10/2011 |
| WO | 2011125881 | A1 | 10/2011 |

OTHER PUBLICATIONS

S. Ray et al., "Poly-alpha-olefin-based synthetic lubricants: a short review on various synthetic routes", Lubrication Science, 2012, vol. 24, Iss. 1, pp. 23-44.

S. Mazzo-Skalski, "SpectraSyn Elite mPAO extends synthetic basestock performance range", Tribology & Lubrication Technology, 2010, vol. 66, Iss. 11, pp. 40-42.

International Search Report and Written Opinion of the International Searching Authority for PCT/US2012/054764.

International Search Report and Written Opinion of the International Searching Authority for PCT/US2012/054773.

International Search Report and Written Opinion of the International Searching Authority for PCT/US2012/054779.

* cited by examiner

LOW VISCOSITY ENGINE OIL COMPOSITIONS

PRIORITY CLAIM

This application claims priority to U.S. Application 61/545,386 which was filed Oct. 10, 2011, U.S. Application 61/545,393 which was filed Oct. 10, 2011, and U.S. Application 61/545,398 which was filed Oct. 10, 2011.

BACKGROUND

There is currently a trend towards maximizing the fuel economy benefits provided by passenger car engine oils (PCEOs). In general, lower viscosity engine oils will provide higher efficiency than higher viscosity engine oils. Attempts have been made to use conventional low viscosity polyalphaolefin base stocks (PAOs) to achieve low viscosity engine oil formulations. Such conventional PAOs, such as conventional PAO 4 cSt, KV100, can be produced by the use of Friedel-Craft catalysts, such as aluminum trichloride or boron trifluoride, and a protic promoter. The volatility requirements for engine oils, however, limit the amount of low viscosity conventional PAO that can be used and the extent to which the viscosity of the engine oil formulation can be reduced. PCEOs that are too volatile can cause high oil consumption problems. High oil consumption is undesirable for consumers as it creates the need for more frequent oil additions and changes.

Others have attempted to formulate PCEOs with other PAOs, such as metallocene-catalyzed PAOs (mPAOs). However, others have not achieved ultra low viscosity engine oil formulations (e.g., kinematic viscosities at 100° C. of 6 cSt or less). For example, US 2009/0181872 discloses lubricating oil compositions for internal combustion engines. The examples include compositions containing low viscosity metallocene catalyzed PAO (mPAO). These compositions, however, have kinematic viscosities at 100° C. of 8.109 cSt or higher. In addition, while these compositions have Noack volatilities (250° C., 1 hr) of as low as 7.6 mass %, the compositions contain mPAO only in amounts of up to 40 wt % of the composition. Additionally, the compositions have CCS viscosities at −35° C. of 3600 mPa·s, or higher, and include a viscosity index improver additive component in the amount of 4.0 mass %.

US 2011/0039743 discloses lubricating oils using a 3.9 cSt "INVENTION" fluid. For example, it discloses 0W-30 and 0W-40 passenger car motor oils, and 5W-40 heavy duty diesel engine oils, using the 3.9 cSt "INVENTION" fluid. These compositions, however, have kinematic viscosities at 100° C. of 10.8 cSt or higher. In addition, while these compositions have Noack volatilities of as low as 7.4 wt % loss, the compositions contain the 3.9 cSt "INVENTION" fluid only in amounts of up to 48.5 wt % of the composition. Additionally, the compositions have CCS viscosities at −35° C. of 5010 cP or higher, and include a viscosity modifier additive solution in the amount of 4.0 wt % or higher. US 2011/0039743 also discloses example compressor/turbine oil, industrial and transportation gear oil, and automatic transmission fluid oil formulations.

WO2011125879, WO2011125880 and WO2011125881 disclose lubricant to compositions for an internal combustion engine comprising: (A) a polyalphaolefin that has a kinetic viscosity at 100° C. of at most 5.5 $mm^2/s$, a CCS viscosity at −35° C. of at most 3,000 mPa·s, and a NOACK of at most 12 mass %; and (B) a mineral oil with a viscosity index of at least 120. WO2011125879 and WO2011125881 disclose that Component (A) constitutes at least 25% of the entire composition by mass. WO2011125880 discloses that Component (A) constitutes at least 10% of the entire composition by mass. WO2011125881 also discloses that the lubricant composition comprises a polyisobutylene with a mass-average molecular weight of at least 500,000. The Tables of WO2011125879, WO2011125880 and WO2011125881 do not indicate the overall kinematic viscosities at 100° C. (KV100) of the compositions, but the compositions contain the 3.458 $mm^2/s$ mPAO only in amounts of up to 30% of the composition. Additionally, each of the compositions contain combined amounts of viscosity index improver solution and polyisobutylene solution of 7.0 mass %. While these compositions have Noack volatilities of as low as 9.1 mass %, the compositions have CCS viscosities at −35° C. of 4300 mPa·s or higher.

US 2010/0062954 discloses transmission fluid compositions that contain metallocene catalyzed PAO. These transmission fluid compositions, however, each include viscosity index improver additives, and would possess properties that differ significantly from the passenger car engine oils of the current inventions, such as deposit performance, total base number (TBN), ball rust test performance and sulfated ash levels.

There is thus a need for new, ultra-low viscosity passenger car engine oils with overall kinematic viscosities at 100° C. of from 4 to 6 cSt that achieve greater levels of fuel economy improvement, while meeting volatility performance requirements. Such ultra-low viscosity PCEOs could be categorized as SAE "0W" viscosity monograded oils.

In order to achieve ultra-low viscosity PCEO formulations, high quality, low viscosity PAOs are needed. This demand for high quality PAOs has been increasing for several years, driving research in alternatives to the Friedel-Craft process. Metallocene catalyst systems are one such alternative. In the past, most of the metallocene-based focus has been on high-viscosity-index-PAOs (HVI-PAOs) and higher viscosity oils for industrial and commercial applications. Examples include U.S. Pat. No. 6,706,828, which discloses a process for producing PAOs from meso-forms of certain metallocene catalysts with methylalumoxane (MAO). Others have made various PAOs, such as polydecene, using various metallocene catalysts not typically known to produce polymers or oligomers with any specific tacticity. Examples include U.S. Pat. No. 5,688,887, U.S. Pat. No. 6,043,401, WO 03/020856, U.S. Pat. No. 5,087,788, U.S. Pat. No. 6,414,090, U.S. Pat. No. 6,414,091, U.S. Pat. No. 4,704,491, U.S. Pat. No. 6,133,209, and U.S. Pat. No. 6,713,438. ExxonMobil Chemical Company has been active in the field and has several pending patent applications on processes using various bridged and unbridged metallocene catalysts. Examples include published applications WO 2007/011832, WO 2008/010865, WO 2009/017953, and WO 2009/123800.

Recent research, however, has looked at producing low viscosity PAOs for automotive applications. The current trend in the automotive industry toward extending oil drain intervals and improving fuel economy is driving increasingly stringent performance requirements for lubricants. New PAOs with improved properties such as high viscosity index, low pour point, high shear stability, improved wear performance, increased thermal and oxidative stability, and/or wider viscosity ranges are needed to meet these new performance requirements. New methods to produce such PAOs are also needed. US 2007/0043248 discloses a process using a metallocene catalyst for the production of low viscosity (4 to 10 cSt) PAO basestocks. This technology is attractive because the metallocene-based low viscosity PAO has excellent lubricant properties.

While low viscosity metallocene-catalyzed PAOs possess excellent properties, one disadvantage of the low viscosity metallocene-catalyzed process is that a significant amount of dimer is formed. This dimer is not useful as a lubricant basestock because it has very poor low temperature and volatility properties. Recent industry research has looked at recycling the dimer portion formed in the metallocene-catalyzed process into a subsequent oligomerization process.

U.S. Pat. No. 6,548,724 discloses a multistep process for the production of a PAO in which the first step involves polymerization of a feedstock in the presence of a bulky ligand transition metal catalyst and a subsequent step involves the oligomerization of some portion of the product of the first step in the presence of an acid catalyst. The dimer product formed by the first step of U.S. Pat. No. 6,548,724 exhibits at least 50%, and preferably more than 80%, of terminal vinylidene content. The product of the subsequent step in U.S. Pat. No. 6,548,724 is a mixture of dimers, trimers, and higher oligomers, and yield of the trimer product is at least 65%.

U.S. Pat. No. 5,284,988 discloses a multistep process for the production of a PAO in which a vinylidene dimer is first isomerized to form a tri-substituted dimer. The tri-substituted dimer is then reacted with a vinyl olefin in the presence of an acid catalyst to form a co-dimer of said tri-substituted dimer and said vinyl olefin. U.S. Pat. No. 5,284,988 shows that using the tri-substituted dimer, instead of the vinylidene dimer, as a feedstock in the subsequent oligomerization step results in a higher selectivity of said co-dimer and less formation of product having carbon numbers greater than or less than the sum of the carbon members of the vinylidene and alpha-olefin. As a result, the lubricant may be tailored to a specific viscosity at high yields, which is highly desirable due to lubricant industry trends and demands. The U.S. Pat. No. 5,284,988 process, however, requires the additional step of isomerization to get the tri-substituted dimer. Additionally, the reaction rates disclosed in U.S. Pat. No. 5,284,988 are very slow, requiring 2-20 days to prepare the initial vinylidene dimer.

An additional example of a process involving the recycle of a dimer product is provided in US 2008/0146469, which discloses an intermediate comprised primarily of vinylidene.

SUMMARY

This invention is directed to ultra-low viscosity passenger car engine oil compositions with a kinematic viscosity at 100° C. of from 4 to 6 cSt, and comprising in admixture 60 wt % to 90 wt % of a first base oil component, based on the total weight of the composition, the first base oil component consisting of a polyalphaolefin (PAO) base stock or combination of polyalphaolefin (PAO) base stocks, each having a kinematic viscosity at 100° C. of from 3.2 cSt to 3.8 cSt; and 0.1 wt % to 20 wt % of a second base oil component, based on the total weight of the composition, the second base oil component consisting of a Group II, Group III or Group V base stock, or any combination thereof; wherein the composition comprises from 0 wt % to less than 0.25 wt % viscosity index improver, on a solid polymer basis; wherein the composition has a kinematic viscosity at 100° C. of from 4 to 6 cSt, a Noack volatility of less than 15% as determined by ASTM D5800, a CCS viscosity of less than 3500 cP at −35° C. as determined by ASTM D5293, and an HTHS viscosity of less than 2.6 mPa·s at 150° C. as determined by ASTM D4683.

Also disclosed herein is a PAO formed in a first oligomerization, wherein at least portions of this PAO have properties that make said portions highly desirable as feedstocks to a subsequent oligomerization. One preferred process for producing this invention uses a single site catalyst at high temperatures without adding hydrogen in the first oligomerization to produce a low viscosity PAO with excellent Noack volatility at high conversion rates. The PAO formed comprises a distribution of products, including dimers, trimers, and higher oligomers. This PAO or the respective dimer, trimer, and further oligomer portions may hereinafter be referred to as the "intermediate PAO," "intermediate PAO dimer," "intermediate PAO trimer," and the like. The term "intermediate PAO" and like terms are used in this disclosure only to differentiate PAOs formed in the first oligomerization from PAOs formed in any subsequent oligomerization, and said terms are not intended to have any meaning beyond being useful for making this differentiation. When the first oligomerization uses a metallocene based catalyst system, the resulting PAO may also be referred to as "intermediate mPAO", as well as portions thereof may be referred to as "intermediate mPAO dimer," "intermediate mPAO trimer," and the like.

The intermediate PAO comprises a tri-substituted vinylene dimer that is highly desirable as a feedstock for a subsequent oligomerization. This intermediate PAO also comprises trimer and optionally tetramer and higher oligomer portions with outstanding properties that make these portions useful as lubricant basestocks following hydrogenation. The hydrogenated trimer portion can be used as the first base stock component, or a portion of the first base stock component, in the inventive engine oil compositions. In an embodiment, the intermediate PAO dimer portion comprises greater than 25 wt % tri-substituted vinylene olefins. This intermediate PAO dimer comprising greater than 25 wt % tri-substituted vinylene olefins has properties that make it especially desirable for a subsequent recycle to a second oligomerization in the presence of an optional linear alpha olefin (LAO) feed comprising one or more $C_6$ to $C_{24}$ olefins, an oligomerization catalyst, and an activator. The structure, especially the olefin location, of this intermediate PAO dimer is such that, when recycled and reacted under such conditions, it reacts preferentially with the LAO, instead of reacting with other intermediate PAO dimer, to form a co-dimer at high yields. In the present invention, the term "co-dimer" is used to designate the reaction product of the intermediate PAO dimer with a linear alpha olefin (LAO) monomer.

Also disclosed herein is a two-step oligomerization process for producing low viscosity PAOs useful as a lubricant base stock, such as in the inventive engine oil compositions of the present disclosure. In the first oligomerization step, a catalyst, an activator, and a monomer are contacted in a first reactor to obtain a first reactor effluent, the effluent comprising a dimer product (or intermediate PAO dimer), a trimer product (or intermediate PAO trimer), and optionally a higher oligomer product (or intermediate PAO higher oligomer product), wherein the dimer product contains at least 25 wt % of tri-substituted vinylene represented by the following structure:

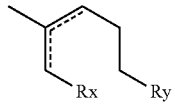

and the dashed line represents the two possible locations where the unsaturated double bond may be located and Rx and Ry are independently selected from a $C_3$ to $C_{21}$ alkyl group. Preferably, in the first oligomerization step, a monomer feed comprising one or more $C_6$ to $C_{24}$ olefins is oligomerized at high temperatures (80-150° C.) in the presence of a single site catalyst and an activator without adding hydrogen. The residence time in this first reactor may range from 1 to 6 hours. The intermediate PAO formed comprises a distribution of products. The structure, especially the olefin location, of the intermediate PAO dimer is such that, when recycled and reacted under the second oligomerization conditions, it reacts preferentially with the LAO, instead of reacting with other intermediate PAO dimer, to form a co-dimer at very high yields. This attribute is especially desirable in a process to produce low viscosity PAOs, and the resulting PAOs have improved low temperature properties and a better balance between viscosity and volatility properties than what has been achieved in prior processes. In the second oligomerization step, at least a portion of the dimer product (or intermediate PAO dimer) is fed to a second reactor wherein it is contacted with a second catalyst, a second activator, and optionally a second monomer therefore obtaining a second reactor effluent comprising a PAO. Preferably, in the second step, at least this intermediate PAO dimer portion of the first reactor effluent is recycled to a second reactor and oligomerized in the presence of an optional linear alpha olefin (LAO) feed comprising one or more $C_6$ to $C_{24}$ olefins, an oligomerization catalyst, and an activator. The residence time in this second reactor may also range from 1 to 6 hours.

This two-step process allows the total useful lubricant basestocks yields in a process to produce low viscosity PAOs to be significantly increased, which improves process economics. Importantly, the structure and especially the linear character of the intermediate PAO dimer make it an especially desirable feedstock to the subsequent oligomerization. It has high activity and high selectivity in forming the co-dimer.

Also disclosed herein are new PAO compositions that exhibit unique properties. A preferred way of obtaining these new PAO compositions utilizes the disclosed two-step process. The PAOs produced in the subsequent oligomerization have ultra-low viscosities, excellent Noack volatilities, and other properties that make them extremely desirable as basestocks for low viscosity lubricant applications, especially in the automotive market.

DETAILED DESCRIPTION

This invention is directed to ultra-low viscosity passenger car engine oil compositions with a kinematic viscosity at 100° C. of from 4 to 6 cSt, and comprising in admixture 60 wt % to 90 wt % of a first base oil component, based on the total weight of the composition, the first base oil component consisting of a polyalphaolefin base stock or combination of polyalphaolein base stocks, each having a kinematic viscosity at 100° C. of from 3.2 cSt to 3.8 cSt; and 0.1 wt % to 20 wt % of a second base oil component, based on the total weight of the composition, the second base oil component consisting of a Group II, Group III or Group V base stock, or any combination thereof; wherein the composition comprises from 0 wt % to less than 0.25 wt % viscosity index improver, on a solid polymer basis; wherein the composition has a kinematic viscosity at 100° C. of from 4 to 6 cSt, a Noack volatility of less than 15% as determined by ASTM D5800, a CCS viscosity of less than 3500 cP at −35° C. as determined by ASTM D5293, and an HTHS viscosity of less than 2.6 mPa·s at 150° C. as determined by ASTM D4683.

The terms "base oil" and "base stock" as referred to herein are to be considered consistent with the definitions as stated in API BASE OIL INTERCHANGEABILITY GUIDELINES FOR PASSENGER CAR MOTOR OILS AND DIESEL ENGINE OILS, July 2009 Version—APPENDIX E. According to Appendix E, base oil is the base stock or blend of base stocks used in an API-licensed oil. Base stock is a lubricant component that is produced by a single manufacturer to the same specifications (independent of feed source or manufacturer's location); that meets the same manufacturer's specification; and that is identified by a unique formula, product identification number, or both.

As also set forth in Appendix E, Group I base stocks contain less than 90 percent saturates, tested according to ASTM D2007 and/or greater than 0.03 percent sulfur, tested according to ASTM D1552, D2622, D3120, D4294, or D4927; and a viscosity index of greater than or equal to 80 and less than 120, tested according to ASTM D2270. Group II base stocks contain greater than or equal to 90 percent saturates; less than or equal to 0.03 percent sulfur; and a viscosity index greater than or equal to 80 and less than 210. Group III base stocks contain greater than or equal to 90 percent saturates; less than or equal to 0.03 percent sulfur; and a viscosity index greater than or equal to 120. Group IV base stocks are polyalphaolefins (PAOs). Group V base stocks include all other base stocks not included in Group I, II, III, or IV.

Low Viscosity PAO Base Stocks

The first base oil component of the current inventions consists of a low viscosity polyalphaolefin base stock or combination of low viscosity polyalphaolefin base stocks, each having a kinematic viscosity at 100° C. of from 3.2 cSt to 3.8 cSt. These low viscosity polyalphaolefin ("PAO") base stocks may be made by the metallocene catalyzed process or the two-step process described herein.

This invention is also directed to a two-step process for the preparation of improved poly alpha olefins that can be used to formulate the inventive engine oil compositions. In a preferred embodiment, the first step involves oligomerizing low molecular weight linear alpha olefins in the presence of a single site catalyst and the second step involves oligomerization of at least a portion of the product from the first step in the presence of an oligomerization catalyst.

This invention is also directed to the PAO composition formed in the first oligomerization, wherein at least portions of the PAO have properties that make them highly desirable for subsequent oligomerization. A preferred process for the first oligomerization uses a single site catalyst at high temperatures without adding hydrogen to produce a low viscosity PAO with excellent Noack volatility at high conversion rates. This PAO comprises a dimer product with at least 25 wt % tri-substituted vinylene olefins wherein said dimer product is highly desirable as a feedstock for a subsequent oligomerization. This PAO also comprises trimer and optionally tetramer and higher oligomer products with outstanding properties that make these products useful as lubricant basestocks following hydrogenation. The hydrogenated trimer portion can be used as the first base stock component, or a portion of the first base stock component, in the inventive engine oil compositions.

This invention also is directed to improved PAOs characterized by very low viscosity and excellent Noack volatility that are obtained following the two-step process.

The PAOs formed in the invention, both intermediate and final PAOs, are liquids. For the purposes of this invention, a term "liquid" is defined to be a fluid that has no distinct melting point above 0° C., preferably no distinct melting point above −20° C., and has a kinematic viscosity at 100° C.

of 3000 cSt or less—though all of the liquid PAOs of the present invention have a kinematic viscosity at 100° C. of 20 cSt or less as further disclosed.

When used in the present invention, in accordance with conventional terminology in the art, the following terms are defined for the sake of clarity. The term "vinyl" is used to designate groups of formula RCH═$CH_2$. The term "vinylidene" is used to designate groups of formula RR'═$CH_2$. The term "disubstituted vinylene" is used to designate groups of formula RCH═CHR. The term "trisubstituted vinylene" is used to designate groups of formula RR'C═CHR". The term "tetrasubstituted vinylene" is used to designated groups of formula RR'C═CR"R'". For all of these formulas, R, R', R", and R'" are alkyl groups which may be identical or different from each other.

The monomer feed used in both the first oligomerization and optionally contacted with the recycled intermediate PAO dimer and light olefin fractions in the subsequent oligomerization is at least one linear alpha olefin (LAO) typically comprised of monomers of 6 to 24 carbon atoms, usually 6 to 20, and preferably 6 to 14 carbon atoms, such as 1-hexene, 1-octene, 1-nonene, 1-decene, 1-dodecene, and 1-tetradecene. Olefins with even carbon numbers are preferred LAOs. Additionally, these olefins are preferably treated to remove catalyst poisons, such as peroxides, oxygen, sulfur, nitrogen-containing organic compounds, and/or acetylenic compounds as described in WO 2007/011973.

Catalyst

Useful catalysts in the first oligomerization include single site catalysts. In a preferred embodiment, the first oligomerization uses a metallocene catalyst. In this disclosure, the terms "metallocene catalyst" and "transition metal compound" are used interchangeably. Preferred classes of catalysts give high catalyst productivity and result in low product viscosity and low molecular weight. Useful metallocene catalysts may be bridged or un-bridged and substituted or unsubstituted. They may have leaving groups including dihalides or dialkyls. When the leaving groups are dihalides, tri-alkylaluminum may be used to promote the reaction. In general, useful transition metal compounds may be represented by the following formula:

$$X_1X_2M_1(CpCp^*)M_2X_3X_4$$

wherein:

$M_1$ is an optional bridging element, preferably selected from silicon or carbon;

$M_2$ is a Group 4 metal;

Cp and Cp* are the same or different substituted or unsubstituted cyclopentadienyl ligand systems wherein, if substituted, the substitutions may be independent or linked to form multicyclic structures;

$X_1$ and $X_2$ are independently hydrogen, hydride radicals, hydrocarbyl radicals, substituted hydrocarbyl radicals, silylcarbyl radicals, substituted silylcarbyl radicals, germylcarbyl radicals, or substituted germylcarbyl radicals or are preferably independently selected from hydrogen, branched or unbranched $C_1$ to $C_{20}$ hydrocarbyl radicals, or branched or unbranched substituted $C_1$ to $C_{20}$ hydrocarbyl radicals; and $X_3$ and $X_4$ are independently hydrogen, halogen, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both $X_3$ and $X_4$ are joined and bound to the metal atom to form a metallacycle ring containing from about 3 to about 20 carbon atoms, or are preferably independently selected from hydrogen, branched or unbranched $C_1$ to $C_{20}$ hydrocarbyl radicals, or branched or unbranched substituted $C_1$ to $C_{20}$ hydrocarbyl radicals.

For this disclosure, a hydrocarbyl radical is $C_1$-$C_{100}$ radical and may be linear, branched, or cyclic. A substituted hydrocarbyl radical includes halocarbyl radicals, substituted halocarbyl radicals, silylcarbyl radicals, and germylcarbyl radicals as these terms are defined below.

Substituted hydrocarbyl radicals are radicals in which at least one hydrogen atom has been substituted with at least one functional group such as $NR^*_2$, OR*, SeR*, TeR*, $PR^*_2$, $AsR^*_2$, $SbR^*_2$, SR*, $BR^*_2$, $SiR^*_3$, $GeR^*_3$, $SnR^*_3$, $PbR^*_3$ and the like or where at least one non-hydrocarbon atom or group has been inserted within the hydrocarbyl radical, such as —O—, —S—, —Se—, —Te—, —N(R*)—, ═N—, —P(R*)—, ═P—, —As(R*)—, ═As—, —Sb(R*)—, ═Sb—, —B(R*)—, ═B—, —$Si(R^*)_2$—, —$Ge(R^*)_2$—, —$Sn(R^*)_2$—, —$Pb(R^*)_2$— and the like, where R* is independently a hydrocarbyl or halocarbyl radical, and two or more R* may join together to form a substituted or unsubstituted saturated, partially unsaturated or aromatic cyclic or polycyclic ring structure.

Halocarbyl radicals are radicals in which one or more hydrocarbyl hydrogen atoms have been substituted with at least one halogen (e.g., F, Cl, Br, I) or halogen-containing group (e.g., $CF_3$).

Substituted halocarbyl radicals are radicals in which at least one halocarbyl hydrogen or halogen atom has been substituted with at least one functional group such as $NR^*_2$, OR*, SeR*, TeR*, $PR^*_2$, $AsR^*_2$, $SbR^*_2$, SR*, $BR^*_2$, SiR*K, $GeR^*_3$, $SnR^*_3$, $PbR^*_3$ and the like or where at least one non-carbon atom or group has been inserted within the halocarbyl radical such as —O—, —S—, —Se—, —Te—, —N(R*)—, ═N—, —P(R*)—, ═P—, —As(R*)—, ═As—, —Sb(R*)—, ═Sb—, —B(R*)—, ═B—, —$Si(R^*)_2$—, —$Ge(R^*)_2$—, —$Sn(R^*)_2$—, —$Pb(R^*)_2$— and the like, where R* is independently a hydrocarbyl or halocarbyl radical provided that at least one halogen atom remains on the original halocarbyl radical. Additionally, two or more R* may join together to form a substituted or unsubstituted saturated, partially unsaturated or aromatic cyclic or polycycyclic ring structure.

Silylcarbyl radicals (also called silylcarbyls) are groups in which the silyl functionality is bonded directly to the indicated atom or atoms. Examples include $SiH_3$, $SiH_2R^*$, $SiHR^*_2$, $SiR^*_3$, $SiH_2(OR^*)$, $SiH(OR^*)_2$, $Si(OR^*)_3$, $SiH_2(NR^*_2)$, $SiH(NR^*_2)_2$, $Si(NR^*_2)_3$, and the like where R* is independently a hydrocarbyl or halocarbyl radical and two or more R* may join together to form a substituted or unsubstituted saturated, partially unsaturated or aromatic cyclic or polycyclic ring structure.

Germylcarbyl radicals (also called germylcarbyls) are groups in which the germyl functionality is bonded directly to the indicated atom or atoms. Examples include $GeH_3$, $GeH_2R^*$, $GeHR^*_2$, $GeR^5_3$, $GeH_2(OR^*)$, $GeH(OR^*)_2$, $Ge(OR^*)_3$, $GeH_2(NR^*_2)$, $GeH(NR^*_2)_2$, $Ge(NR^*_2)_3$, and the like where R* is independently a hydrocarbyl or halocarbyl radical and two or more R* may join together to form a substituted or unsubstituted saturated, partially unsaturated or aromatic cyclic or polycyclic ring structure.

In an embodiment, the transition metal compound may be represented by the following formula:

$$X_1X_2M_1(CpCp^*)M_2X_3X_4$$

wherein:

$M_1$ is a bridging element, and preferably silicon;

$M_2$ is a Group 4 metal, and preferably titanium, zirconium or hafnium;

Cp and Cp* are the same or different substituted or unsubstituted indenyl or tetrahydroindenyl rings that are each bonded to both $M_1$ and $M_2$;

$X_1$ and $X_2$ are independently hydrogen, hydride radicals, hydrocarbyl radicals, substituted hydrocarbyl radicals, silylcarbyl radicals, substituted silylcarbyl radicals, germylcarbyl radicals, or substituted germylcarbyl radicals; and $X_3$ and $X_4$ are independently hydrogen, halogen, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both $X_3$ and $X_4$ are joined and bound to the metal atom to form a metallacycle ring containing from about 3 to about 20 carbon atoms.

In using the terms "substituted or unsubstituted tetrahydroindenyl," "substituted or unsubstituted tetrahydroindenyl ligand," and the like, the substitution to the aforementioned ligand may be hydrocarbyl, substituted hydrocarbyl, halocarbyl, substituted halocarbyl, silylcarbyl, or germylcarbyl. The substitution may also be within the ring giving heteroindenyl ligands or heterotetrahydroindenyl ligands, either of which can additionally be substituted or unsubstituted.

In another embodiment, useful transition metal compounds may be represented by the following formula:

$$L^A L^B L^C_i MDE$$

wherein:

$L^A$ is a substituted cyclopentadienyl or heterocyclopentadienyl ancillary ligand π-bonded to M;

$L^B$ is a member of the class of ancillary ligands defined for $L^A$, or is J, a heteroatom ancillary ligand σ-bonded to M; the $L^A$ and $L^B$ ligands may be covalently bridged together through a Group 14 element linking group;

$L^C_i$ is an optional neutral, non-oxidizing ligand having a dative bond to M (i equals 0 to 3);

M is a Group 4 or 5 transition metal; and

D and E are independently monoanionic labile ligands, each having a π-bond to M, optionally bridged to each other or $L^A$ or $L^B$. The mono-anionic ligands are displaceable by a suitable activator to permit insertion of a polymerizable monomer or a macromonomer can insert for coordination polymerization on the vacant coordination site of the transition metal compound.

One embodiment of this invention uses a highly active metallocene catalyst. In this embodiment, the catalyst productivity is greater than 15,000

$$\frac{g_{PAO}}{g_{catalyst}},$$

preferably greater than 20,000

$$\frac{g_{PAO}}{g_{catalyst}},$$

preferably greater than 25,000

$$\frac{g_{PAO}}{g_{catalyst}},$$

and more preferably greater than 30,000

$$\frac{g_{PAO}}{g_{catalyst}},$$

wherein $$\frac{g_{PAO}}{g_{catalyst}}$$

represents grams of PAO formed per grams of catalyst used in the oligomerization reaction.

High productivity rates are also achieved. In an embodiment, the productivity rate in the first oligomerization is greater than 4,000

$$\frac{g_{PAO}}{g_{catalyst} * \text{hour}},$$

preferably greater than 6,000

$$\frac{g_{PAO}}{g_{catalyst} * \text{hour}},$$

preferably greater than 8,000

$$\frac{g_{PAO}}{g_{catalyst} * \text{hour}},$$

preferably greater than 10,000

$$\frac{g_{PAO}}{g_{catalyst} * \text{hour}},$$

wherein $$\frac{g_{PAO}}{g_{catalyst}}$$

represents grams of PAO formed per grams of catalyst used in the oligomerization reaction.

Activator

The catalyst may be activated by a commonly known activator such as non-coordinating anion (NCA) activator. An NCA is an anion which either does not coordinate to the catalyst metal cation or that coordinates only weakly to the metal cation. An NCA coordinates weakly enough that a neutral Lewis base, such as an olefinically or acetylenically unsaturated monomer, can displace it from the catalyst center. Any metal or metalloid that can form a compatible, weakly coordinating complex with the catalyst metal cation may be used or contained in the NCA. Suitable metals include, but are not limited to, aluminum, gold, and platinum. Suitable metalloids include, but are not limited to, boron, aluminum, phosphorus, and silicon.

Lewis acid and ionic activators may also be used. Useful but non-limiting examples of Lewis acid activators include triphenylboron, tris-perfluorophenylboron, tris-perfluorophenylaluminum, and the like. Useful but non-limiting examples of ionic activators include dimethylanilinium tetrakisperfluorophenylborate, triphenylcarbonium tetrakisperfluorophenylborate, dimethylanilinium tetrakisperfluorophenylaluminate, and the like.

An additional subclass of useful NCAs comprises stoichiometric activators, which can be either neutral or ionic. Examples of neutral stoichiometric activators include tri-substituted boron, tellurium, aluminum, gallium and indium or mixtures thereof. The three substituent groups are each independently selected from alkyls, alkenyls, halogen, substituted alkyls, aryls, arylhalides, alkoxy and halides. Preferably, the three groups are independently selected from halogen, mono or multicyclic (including halosubstituted) aryls, alkyls, and alkenyl compounds and mixtures thereof, preferred are alkenyl groups having 1 to 20 carbon atoms, alkyl groups having 1 to 20 carbon atoms, alkoxy groups having 1 to 20 carbon atoms and aryl groups having 3 to 20 carbon atoms (including substituted aryls). More preferably, the three groups are alkyls having 1 to 4 carbon groups, phenyl, naphthyl or mixtures thereof. Even more preferably, the three groups are halogenated, preferably fluorinated, aryl groups. Ionic stoichiometric activator compounds may contain an active proton, or some other cation associated with, but not coordinated to, or only loosely coordinated to, the remaining ion of the ionizing compound.

Ionic catalysts can be prepared by reacting a transition metal compound with an activator, such as $B(C_6F_6)_3$, which upon reaction with the hydrolyzable ligand (X') of the transition metal compound forms an anion, such as ($[B(C_6F_5)_3(X')]^-$), which stabilizes the cationic transition metal species generated by the reaction. The catalysts can be, and preferably are, prepared with activator components which are ionic compounds or compositions. However preparation of activators utilizing neutral compounds is also contemplated by this invention.

Compounds useful as an activator component in the preparation of the ionic catalyst systems used in the process of this invention comprise a cation, which is preferably a Brønsted acid capable of donating a proton, and a compatible NCA which anion is relatively large (bulky), capable of stabilizing the active catalyst species which is formed when the two compounds are combined and said anion will be sufficiently labile to be displaced by olefinic diolefinic and acetylenically unsaturated substrates or other neutral Lewis bases such as ethers, nitriles and the like.

In an embodiment, the ionic stoichiometric activators include a cation and an anion component, and may be represented by the following formula:

$$(L^{**}\text{-}H)_d^+(A^{d-})$$

wherein:

L** is an neutral Lewis base;

H is hydrogen;

(L**-H) is a Brønsted acid or a reducible Lewis Acid; and $A^{d-}$ is an NCA having the charge d−, and d is an integer from 1 to 3.

The cation component, $(L^{**}\text{-}H)_d^+$ may include Brønsted acids such as protons or protonated Lewis bases or reducible Lewis acids capable of protonating or abstracting a moiety, such as an alkyl or aryl, from the catalyst after alkylation.

The activating cation $(L^{}\text{-}H)_d^+$ may be a Brønsted acid, capable of donating a proton to the alkylated transition metal catalytic precursor resulting in a transition metal cation, including ammoniums, oxoniums, phosphoniums, silyliums, and mixtures thereof, preferably ammoniums of methylamine, aniline, dimethylamine, diethylamine, N-methylaniline, diphenylamine, trimethylamine, triethylamine, N,N-dimethylaniline, methyldiphenylamine, pyridine, p-bromo N,N-dimethylaniline, p-nitro-N,N-dimethylaniline, phosphoniums from triethylphosphine, triphenylphosphine, and diphenylphosphine, oxomiuns from ethers such as dimethyl ether, diethyl ether, tetrahydrofuran and dioxane, sulifoniums from thioethers, such as diethyl thioethers and tetrahydrothiophene, and mixtures thereof. The activating cation $(L^{}\text{-}H)_d^+$ may also be a moiety such as silver, tropylium, carbeniums, ferroceniums and mixtures, preferably carboniums and ferroceniums; most preferably triphenyl carbonium. The anion component $A^{d-}$ include those having the formula $[M^{k+}Q_n]^{d-}$ wherein k is an integer from 1 to 3; n is an integer from 2-6; n−k=d; M is an element selected from Group 13 of the Periodic Table of the Elements, preferably boron or aluminum, and Q is independently a hydride, bridged or unbridged dialkylamido, halide, alkoxide, aryloxide, hydrocarbyl, substituted hydrocarbyl, halocarbyl, substituted halocarbyl, and halosubstituted-hydrocarbyl radicals, said Q having up to 20 carbon atoms with the proviso that in not more than one occurrence is Q a halide. Preferably, each Q is a fluorinated hydrocarbyl group having 1 to 20 carbon atoms, more preferably each 0 is a fluorinated aryl group, and most preferably each Q is a pentafluoryl aryl group. Examples of suitable $A^{d-}$ also include diboron compounds as disclosed in U.S. Pat. No. 5,447,895, which is incorporated herein by reference.

Illustrative but non-limiting examples of boron compounds which may be used as an NCA activator in combination with a co-activator are tri-substituted ammonium salts such as: trimethylammonium tetraphenylborate, triethylammonium tetraphenylborate, tripropylammonium tetraphenylborate, tri(n-butyl)ammonium tetraphenylborate, tri(tert-butyl)ammonium tetraphenylborate, N,N-dimethylanilinium tetraphenylborate, N,N-diethylanilinium tetraphenylborate, N,N-dimethyl-(2,4,6-trimethylanilinium)tetraphenylborate, trimethylammonium tetrakis(pentafluorophenyl)borate, triethylammonium tetrakis(pentafluorophenyl)borate, tripropylammonium tetrakis(pentafluorophenyl)borate, tri(n-butyl)ammonium tetrakis(pentafluorophenyl)borate, tri(sec-butyl)ammonium tetrakis(pentafluorophenyl)borate, N,N-dimethylanilinium tetrakis(pentafluorophenyl)borate, N,N-diethylanilinium tetrakis(pentafluorophenyl)borate, N,N-dimethyl-(2,4,6-trimethylanilinium)tetrakis (pentafluorophenyl)borate, trimethylammonium tetrakis-(2,3,4,6-tetrafluorophenyl)borate, triethylammonium tetrakis-(2,3,4,6-tetrafluorophenyl)borate, tripropylammonium tetrakis-(2,3,4,6-tetrafluorophenyl)borate, tri(n-butyl)ammonium tetrakis-(2,3,4,6-tetrafluorophenyl)borate, dimethyl (tert-butyl)ammonium tetrakis-(2,3,4,6-tetrafluorophenyl) borate, N,N-dimethylanilinium tetrakis-(2,3,4,6-tetrafluorophenyl)borate, N,N-diethylanilinium tetrakis-(2,3,4,6-tetrafluorophenyl)borate, N,N-dimethyl-(2,4,6-trimethylanilinium)tetrakis-(2,3,4,6-tetrafluorophenyl) borate, trimethylammonium tetrakis(perfluoronaphthyl) borate, triethylammonium tetrakis(perfluoronaphthyl) borate, tripropylammonium tetrakis(perfluoronaphthyl) borate, tri(n-butyl)ammonium tetrakis(perfluoronaphthyl) borate, tri(tert-butyl)ammonium tetrakis(perfluoronaphthyl) borate, N,N-dimethyl anilinium tetrakis(perfluoronaphthyl) borate, N,N-diethylanilinium tetrakis(perfluoronaphthyl)

borate, N,N-dimethyl-(2,4,6-trimethylanilinium) tetrakis (perfluoronaphthyl)borate, tri ethylammonium tetrakis (perfluorobiphenyl)borate, triethylammonium tetrakis (perfluorobiphenyl)borate, tripropylammonium tetrakis (perfluorobiphenyl)borate, tri(n-butyl)ammonium tetrakis (perfluorobiphenyl)borate, tri(tert-butyl)ammonium tetrakis (perfluorobiphenyl)borate, N,N-dimethylanilinium tetrakis (perfluorobiphenyl)borate, N,N-diethylanilinium tetrakis (perfluorobiphenyl)borate, N,N-dimethyl-(2,4,6-trimethylanilinium)tetrakis(perfluorobiphenyl)borate, trimethylammonium tetrakis(3,5-bis(trifluoromethyl)phenyl)borate, triethylammonium tetrakis(3,5-bis(trifluoromethyl)phenyl)borate, tripropylammonium tetrakis(3,5-bis (trifluoromethyl)phenyl)borate, tri(n-butyl)ammonium tetrakis(3,5-bis(trifluoromethyl)phenyl)borate, tri(tert-butyl) ammonium tetrakis(3,5-bis(trifluoromethyl)phenyl)borate, N,N-dimethylanilinium tetrakis(3,5-bis(trifluoromethyl) phenyl)borate, N,N-diethylanilinium tetrakis(3,5-bis(trifluoromethyl)phenyl)borate, N,N-dimethyl-(2,4,6-trimethylanilinium) tetrakis(3,5-bis(trifluoromethyl)phenyl)borate, and dialkyl ammonium salts such as: di-(iso-propyl)ammonium tetrakis(penta fluorophenyl)borate, and dicyclohexylammonium tetrakis(pentafluorophenyl)borate; and other salts such as tri(o-tolyl)phosphonium tetrakis(pentafluorophenyl)borate, tri(2,6-dimethylphenyl)phosphonium tetrakis(pentafluorophenyl)borate, tropillium tetraphenylborate, triphenylcarbenium tetraphenylborate, triphenylphosphonium tetraphenylborate, triethylsilylium tetraphenylborate, benzene(diazonium)tetraphenylborate, tropillium tetrakis(pentafluorophenyl)borate, triphenylcarbenium tetrakis(pentafluorophenyl)borate, triphenylphosphonium tetrakis (pentafluorophenyl)borate, triethylsilylium tetrakis (pentafluorophenyl)borate, benzene(diazonium)tetrakis (pentafluorophenyl)borate, tropillium tetrakis-(2,3,4,6-tetrafluorophenyl)borate, triphenylcarbenium tetrakis-(2,3,4,6-tetrafluorophenyl)borate, triphenylphosphonium tetrakis-(2,3,4,6-tetrafluorophenyl)borate, triethylsilylium tetrakis-(2,3,4,6-tetrafluorophenyl)borate, benzene(diazonium) tetrakis-(2,3,4,6-tetrafluorophenyl)borate, tropillium tetrakis (perfluoronaphthyl)borate, triphenylcarbenium tetrakis (perfluoronaphthyl)borate, triphenylphosphosphonium tetrakis(perfluoronaphthyl)borate, triethylsilylium tetrakis (perfluoronaphthyl)borate, benzene(diazonium)tetrakis(perfluoronaphthyl)borate, tropillium tetrakis(perfluorobiphenyl)borate, triphenylcarbenium tetrakis(perfluorobiphenyl) borate, triphenylphosphonium tetrakis(perfluorobiphenyl) borate, triethylsilylium tetrakis(perfluorobiphenyl)borate, benzene(diazonium)tetrakis(perfluorobiphenyl)borate, tropillium tetrakis(3,5-bis(trifluoromethyl)phenyl)borate, triphenylcarbenium tetrakis(3,5-bis(trifluoromethyl)phenyl)borate, triphenylphosphonium tetrakis(3,5-bis(trifluoromethyl) phenyl)borate, triethylsilylium tetrakis(3,5-bis (trifluoromethyl)phenyl)borate, and benzene(diazonium) tetrakis(3,5-bis(trifluoromethyl)phenyl)borate.

In an embodiment, the NCA activator, $(L^{**}\text{-}H)_d^+ (A^{d-})$, is N,N-dimethylanilinium tetrakis(perfluorophenyl)borate, N,N-dimethylanilinium tetrakis(perfluoronaphthyl)borate, N,N-dimethyl anilinium tetrakis(perfluorobiphenyl)borate, N,N-dimethylanilinium tetrakis(3,5-bis(trifluoromethyl) phenyl)borate, triphenylcarbenium tetrakis(perfluoronaphthyl)borate, triphenylcarbenium tetrakis(perfluorobiphenyl) borate, triphenylcarbenium tetrakis(3,5-bis(trifluoromethyl) phenyl)borate, or triphenylcarbenium tetra(perfluorophenyl) borate.

Pehlert et al., U.S. Pat. No. 7,511,104 provides additional details on NCA activators that may be useful in this invention, and these details are hereby fully incorporated by reference.

Additional activators that may be used include alumoxanes or alumoxanes in combination with an NCA. In one embodiment, alumoxane activators are utilized as an activator. Alumrnoxanes are generally oligomeric compounds containing —Al(R1)-O— sub-units, where R1 is an alkyl group. Examples of alumoxanes include methylalumoxane (MAO), modified methylalumoxane (MMAO), ethylalumoxane and isobutylalumoxane. Alkylalumoxanes and modified alkylalumoxanes are suitable as catalyst activators, particularly when the abstractable ligand is an alkyl, halide, alkoxide or amide. Mixtures of different alumoxanes and modified alumoxanes may also be used.

A catalyst co-activator is a compound capable of alkylating the catalyst, such that when used in combination with an activator, an active catalyst is formed. Co-activators may include alumoxanes such as methylalumoxane, modified alumoxanes such as modified methylalumoxane, and aluminum alkyls such trimethylaluminum, tri-isobutylaluminum, triethylaluminum, and tri-isopropylaluminum, tri-n-hexylaluminum, tri-n-octylaluminum, tri-n-decylaluminum or tri-n-dodecylaluminum. Co-activators are typically used in combination with Lewis acid activators and ionic activators when the catalyst is not a dihydrocarbyl or dihydride complex. Preferred activators are non-oxygen containing compounds such as the aluminum alkyls, and are preferably trialkylaluminums.

The co-activator may also be used as a scavenger to deactivate impurities in feed or reactors. A scavenger is a compound that is sufficiently Lewis acidic to coordinate with polar contaminates and impurities adventitiously occurring in the polymerization feedstocks or reaction medium. Such impurities can be inadvertently introduced with any of the reaction components, and adversely affect catalyst activity and stability. Useful scavenging compounds may be organometallic compounds such as triethyl aluminum, triethyl borane, tri-isobutyl aluminum, methylalumoxane, isobutyl aluminumoxane, tri-n-hexyl aluminum, tri-n-octyl aluminum, and those having bulky substituents covalently bound to the metal or metalloid center being preferred to minimize adverse interaction with the active catalyst. Other useful scavenger compounds may include those mentioned in U.S. Pat. No. 5,241,025, EP-A 0426638, and WO 97/22635, which are hereby incorporated by reference for such details.

The reaction time or reactor residence time is usually dependent on the type of catalyst used, the amount of catalyst used, and the desired conversion level. Different transition metal compounds (also referred to as metallocene) have different activities. High amount of catalyst loading tends to gives high conversion at short reaction time. However, high amount of catalyst usage make the production process uneconomical and difficult to manage the reaction heat or to control the reaction temperature. Therefore, it is useful to choose a catalyst with maximum catalyst productivity to minimize the amount of metallocene and the amount of activators needed. For the preferred catalyst system of metallocene plus a Lewis Acid or an ionic promoter with NCA component, the transition metal compound use is typically in the range of 0.01 microgram to 500 micrograms of metallocene component/gram of alpha-olefin feed. Usually the preferred range is from 0.1 microgram to 100 microgram of metallocene component per gram of alpha-olefin feed. Furthermore, the molar ratio of the NCA activator to metallocene is in the range from 0.1 to 10, preferably 0.5 to 5, preferably 0.5 to 3. For the co-activators of alkylaluminums, the molar ratio of the co-activator to metallocene is in the range from 1 to 1000, preferably 2 to 500, preferably 4 to 400.

In selecting oligomerization conditions, to obtain the desired first reactor effluent, the system uses the transition metal compound (also referred to as the catalyst), activator, and co-activator.

US 2007/0043248 and US 2010/029242 provides additional details of metallocene catalysts, activators, co-activators, and appropriate ratios of such compounds in the feedstock that may be useful in this invention, and these additional details are hereby incorporated by reference.

Oligomerization Process

Many oligomerization processes and reactor types used for single site- or metallocene-catalyzed oligomerizations such as solution, slurry, and bulk oligomerization processes may be used in this invention. In some embodiments, if a solid catalyst is used, a slurry or continuous fixed bed or plug flow process is suitable. In a preferred embodiment, the monomers are contacted with the metallocene compound and the activator in the solution phase, bulk phase, or slurry phase, preferably in a continuous stirred tank reactor or a continuous tubular reactor. In a preferred embodiment, the temperature in any reactor used herein is from −10° C. to 250° C., preferably from 30° C. to 220° C., preferably from 50° C. to 180° C., preferably from 80° C. to 150° C. In a preferred embodiment, the pressure in any reactor used herein is from 10.13 to 10132.5 kPa (0.1 to 100 atm/1.5 to 1500 psi), preferably from 50.66 to 7600 kPa (0.5 to 75 atm/8 to 1125 psi), and most preferably from 101.3 to 5066.25 kPa (1 to 50 atm/15 to 750 psi). In another embodiment, the pressure in any reactor used herein is from 101.3 to 5,066,250 kPa (1 to 50,000 atm), preferably 101.3 to 2,533,125 kPa (1 to 25,000 atm). In another embodiment, the residence time in any reactor is 1 second to 100 hours, preferably 30 seconds to 50 hours, preferably 2 minutes to 6 hours, preferably 1 to 6 hours. In another embodiment, solvent or diluent is present in the reactor. These solvents or diluents are usually pre-treated in same manners as the feed olefins.

The oligomerization can be run in batch mode, where all the components are added into a reactor and allowed to react to a degree of conversion, either partial or full conversion. Subsequently, the catalyst is deactivated by any possible means, such as exposure to air or water, or by addition of alcohols or solvents containing deactivating agents. The oligomerization can also be carried out in a semi-continuous operation, where feeds and catalyst system components are continuously and simultaneously added to the reactor so as to maintain a constant ratio of catalyst system components to feed olefin(s). When all feeds and catalyst components are added, the reaction is allowed to proceed to a pre-determined stage. The reaction is then discontinued by catalyst deactivation in the same manner as described for batch operation. The oligomerization can also be carried out in a continuous operation, where feeds and catalyst system components are continuously and simultaneously added to the reactor so to maintain a constant ratio of catalyst system and feeds. The reaction product is continuously withdrawn from the reactor, as in a typical continuous stirred tank reactor (CSTR) operation. The residence times of the reactants are controlled by a pre-determined degree of conversion. The withdrawn product is then typically quenched in the separate reactor in a similar manner as other operation. In a preferred embodiment, any of the processes to prepare PAOs described herein are continuous processes.

A production facility may have one single reactor or several reactors arranged in series or in parallel, or both, to maximize productivity, product properties, and general process efficiency. The catalyst, activator, and co-activator may be delivered as a solution or slurry in a solvent or in the LAO feed stream, either separately to the reactor, activated in-line just prior to the reactor, or pre-activated and pumped as an activated solution or slurry to the reactor. Oligomerizations are carried out in either single reactor operation, in which the monomer, or several monomers, catalyst/activator/co-activator, optional scavenger, and optional modifiers are added continuously to a single reactor or in series reactor operation, in which the above components are added to each of two or more reactors connected in series. The catalyst components can be added to the first reactor in the series. The catalyst component may also be added to both reactors, with one component being added to first reaction and another component to other reactors.

The reactors and associated equipment are usually pretreated to ensure proper reaction rates and catalyst performance. The reaction is usually conducted under inert atmosphere, where the catalyst system and feed components will not be in contact with any catalyst deactivator or poison which is usually polar oxygen, nitrogen, sulfur or acetylenic compounds. Additionally, in one embodiment of any of the process described herein, the feed olefins and or solvents are treated to remove catalyst poisons, such as peroxides, oxygen or nitrogen-containing organic compounds or acetylenic compounds. Such treatment will increase catalyst productivity 2- to 10-fold or more.

The reaction time or reactor residence time is usually dependent on the type of catalyst used, the amount of catalyst used, and the desired conversion level. When the catalyst is a metallocene, different metallocenes have different activities. Usually, a higher degree of alkyl substitution on the cyclopentadienyl ring, or bridging improves catalyst productivity. High catalyst loading tends to gives high conversion in short reaction time. However, high catalyst usage makes the process uneconomical and difficult to manage the reaction heat or to control the reaction temperature. Therefore, it is useful to choose a catalyst with maximum catalyst productivity to minimize the amount of metallocene and the amount of activators needed.

US 2007/0043248 and US 2010/0292424 provide significant additional details on acceptable oligomerization processes using metallocene catalysts, and the details of these processes, process conditions, catalysts, activators, co-activators, etc. are hereby incorporated by reference to the extent that they are not inconsistent with anything described in this disclosure.

Due to the low activity of some metallocene catalysts at high temperatures, low viscosity PAOs are typically oligomerized in the presence of added hydrogen at lower temperatures. The advantage is that hydrogen acts as a chain terminator, effectively decreasing molecular weight and viscosity of the PAO. Hydrogen can also hydrogenate the olefin, however, saturating the LAO feedstock and PAO. This would prevent LAO or the PAO dimer from being usefully recycled or used as feedstock into a further oligomerization process. Thus it is an improvement over prior art to be able to make an intermediate PAO without having to add hydrogen for chain termination because the unreacted LAO feedstock and intermediate PAO dimer maintain their unsaturation, and thus their reactivity, for a subsequent recycle step or use as a feedstock in a further oligomerization process.

The intermediate PAO produced is a mixture of dimers, trimers, and optionally tetramer and higher oligomers of the respective alpha olefin feedstocks. This intermediate PAO and portions thereof is referred to interchangeably as the "first reactor effluent" from which unreacted monomers have optionally been removed. In an embodiment, the dimer portion of the intermediate PAO may be a reactor effluent that has not been subject to a distillation process. In another embodiment, the dimer portion of the intermediate PAO may be subjected to a distillation process to separate it from the trimer and optional higher oligomer portion prior to feeding the at least dimer portion of the first reactor to a second reactor. In another embodiment, the dimer portion of the intermediate PAO may be a distillate effluent. In another embodiment, the at least dimer portion of the intermediate PAO is fed directly into the second reactor. In a further embodiment, the trimer portion of the intermediate PAO and the tetramer and higher oligomer portion of the intermediate PAO can be isolated from the first effluent by distillation. In another embodiment, the intermediate PAO is not subjected to a separate isomerization process following oligomerization.

In the invention, the intermediate PAO product has a kinematic viscosity at 100° C. $KV_{100}$) of less than 20 cSt, preferably less than 15 cSt, preferably less than 12 cSt, more preferably less than 10 cSt. In the invention, the intermediate PAO trimer portion after a hydrogenation step has a $KV_{100}$ of less than 4 cSt, preferably less than 3.6 cSt. In an embodiment, the tetramers and higher oligomer portion of the intermediate PAO after a hydrogenation step has a $KV_{100}$ of less than 30 cSt. In an embodiment, the intermediate PAO oligomer portion remaining after the intermediate PAO dimer portion is removed has a $KV_{100}$ of less than 25 cSt.

The intermediate PAO trimer portion has a VI of greater than 125, preferably greater than 130. In an embodiment, the trimer and higher oligomer portion of the intermediate PAO has a VI of greater than 130, preferably greater than 135. In an embodiment, the tetramer and higher oligomer portion of the intermediate PAO has a VI of greater than 150, preferably greater than 155.

The intermediate PAO trimer portion has a Noack volatility that is less than 15 wt %, preferably less than 14 wt %, preferably less than 13 wt %, preferably less than 12 wt %. In an embodiment, the intermediate PAO tetramers and higher oligomer portion has a Noack volatility that is less than 8 wt %, preferably less than 7 wt %, preferably less than 6 wt %.

The intermediate PAO dimer portion has a number average molecular weight in the range of 120 to 600.

The intermediate PAO dimer portion possesses at least one carbon-carbon unsaturated double bond. A portion of this intermediate PAO dimer comprises tri-substituted vinylene. This tri-substituted vinylene has two possible isomer structures that may coexist and differ regarding where the unsaturated double bond is located, as represented by the following structure:

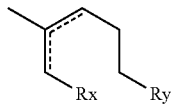

wherein the dashed line represents the two possible locations where the unsaturated double bond may be located and Rx and Ry are independently selected from a $C_3$ to $C_{21}$ alkyl group, preferably from linear $C_3$ to $C_{21}$ alkyl group.

In any embodiment, the intermediate PAO dimer contains greater than 20 wt %, preferably greater than 25 wt %, preferably greater than 30 wt %, preferably greater than 40 wt %, preferably greater than 50 wt %, preferably greater than 60 wt %, preferably greater than 70 wt %, preferably greater than 80 wt % of tri-substituted vinylene olefins represented by the general structure above.

In a preferred embodiment, Rx and Ry are independently $C_3$ to $C_{11}$ alkyl groups. In a preferred embodiment, Rx and Ry are both $C_7$. In a preferred embodiment, the intermediate PAO dimer comprises a portion of tri-substituted vinylene dimer that is represented by the following structure:

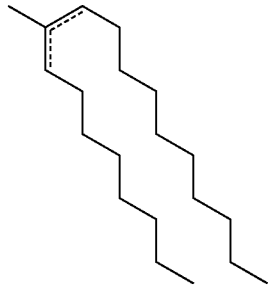

wherein the dashed line represents the two possible locations where the unsaturated double bond may be located.

In any embodiment, the intermediate PAO contains less than 70 wt %, preferably less than 60 wt %, preferably less than 50 wt %, preferably less than 40 wt %, preferably less than 30 wt %, preferably less than 20 wt % of di-substituted vinylidene represented by the formula:

$$RqRzC{=}CH_2$$

wherein Rq and Rz are independently selected from alkyl groups, preferably linear alkyl groups, or preferably $C_3$ to $C_{21}$ linear alkyl groups.

One embodiment of the first oligomerization is illustrated and explained below as a non-limiting example. First, the following reactions show alkylation of a metallocene catalyst with tri n-octyl aluminum followed by activation of the catalyst with N,N-Dimethylanilinium tetrakis (penta-fluorophenyl)borate (1-):

Catalyst Alkylation

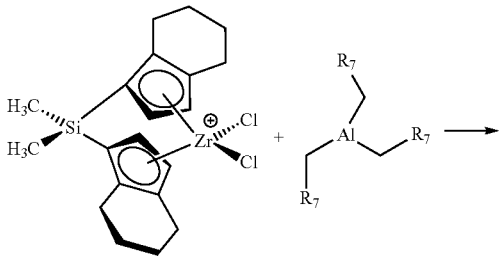

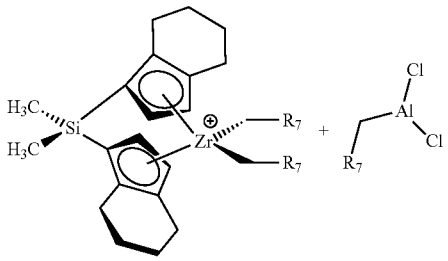

Catalyst Activation
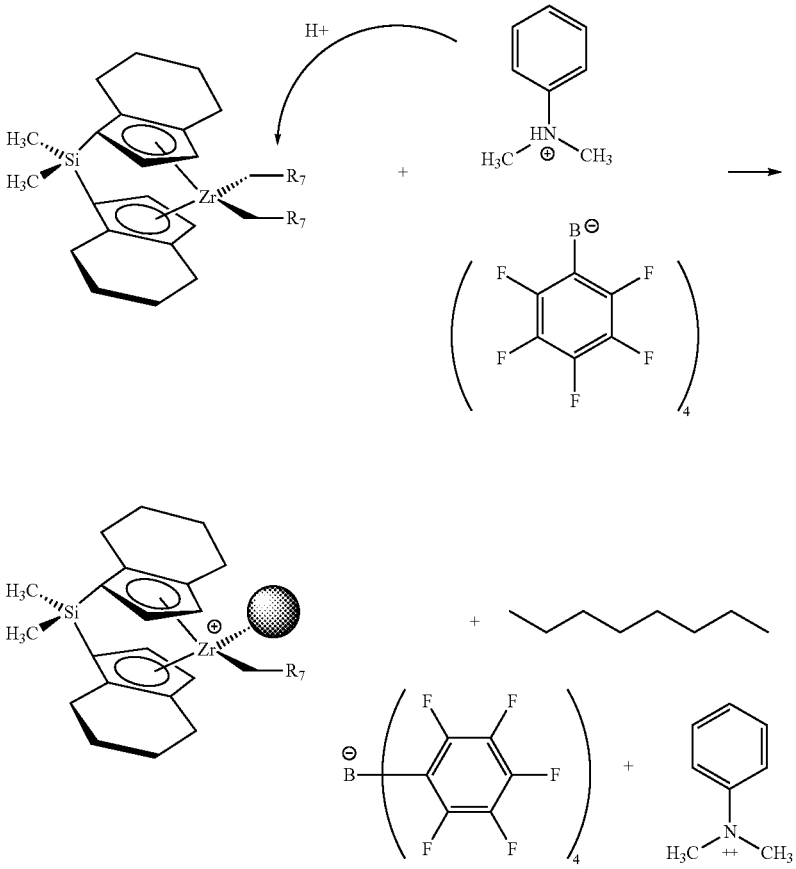
Following catalyst activation, a 1,2 insertion process may take place as shown below:
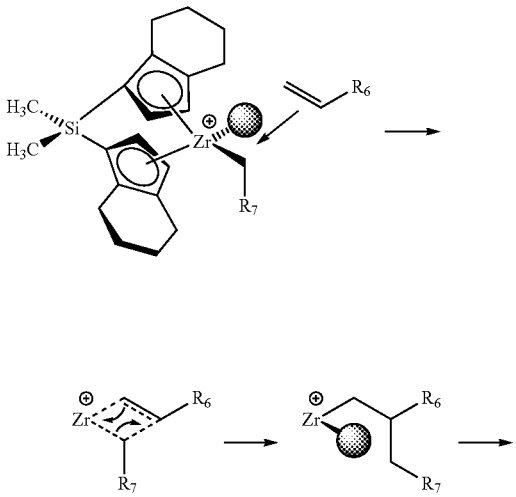
-continued
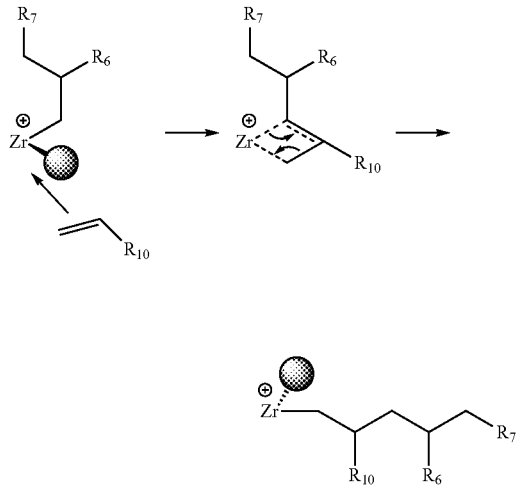
Both vinyl and vinylidene chain ends may be formed as a result of elimination from 1,2 terminated chains, as shown below. This chain termination mechanism shown below competes with propagation during this reaction phase.

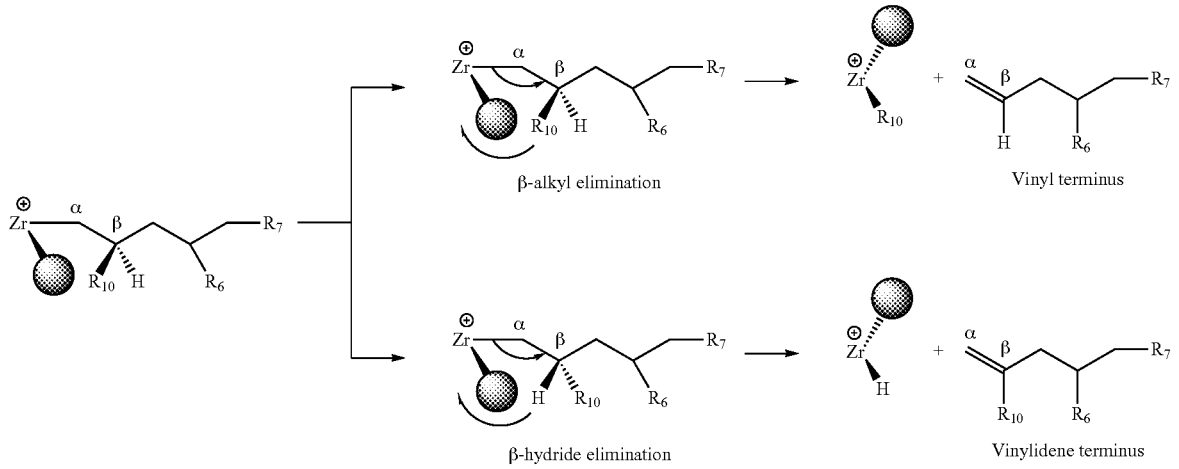

Alternatively following catalyst activation, a 2,1 insertion process may take place as shown below:

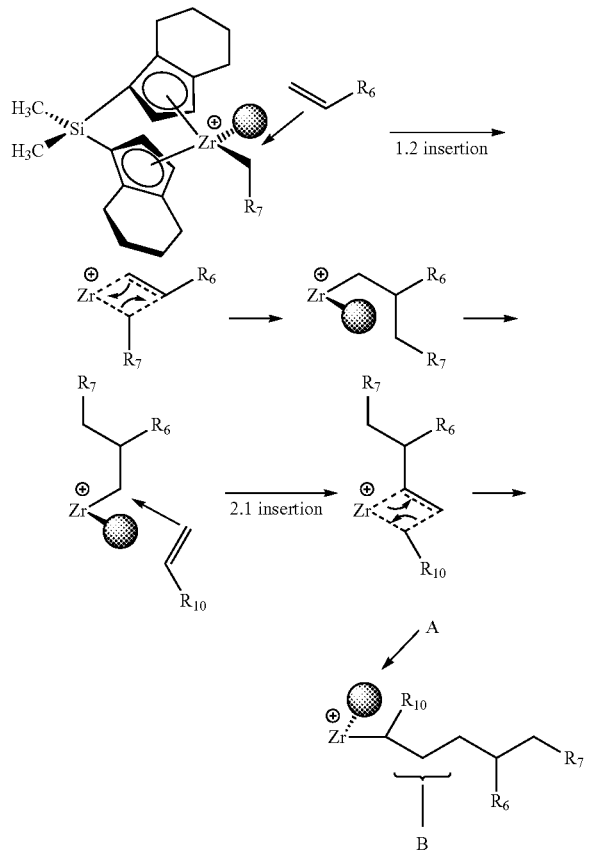

Elimination is favored over propagation after 2,1 insertions due to the proximity of the alpha alkyl branch to the active center (see the area identified with the letter "A" in the reaction above). In other words, the more crowded active site hinders propagation and enhances elimination. 2,1 insertions are detected by nuclear magnetic resonance (NMR) using signals from the unique methylene-methylene unit (see the area identified with the letter "B" in the reaction above).

Certain metallocene catalysts result in a higher occurrence of 2,1 insertions, and elimination from 2,1 terminated chains preferentially forms vinylene chain ends, as shown below.

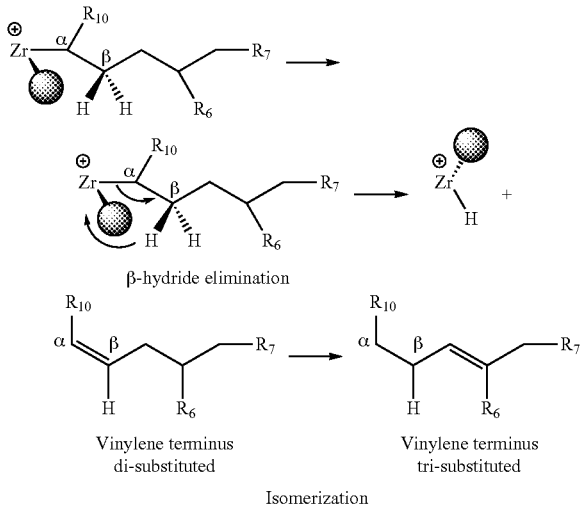

Subsequent Oligomerization

The intermediate PAO dimer from the first oligomerization may be used as the sole olefin feedstock to the subsequent oligomerization or it may be used together with an alpha olefin feedstock of the type used as the olefin starting material for the first oligomerization. Other portions of the effluent from the first oligomerization may also be used as a feedstock to the subsequent oligomerization, including unreacted LAO. The intermediate PAO dimer may suitably be separated from the overall intermediate PAO product by distillation, with the cut point set at a value dependent upon the fraction to be used as lube base stock or the fraction to be used as feed for the subsequent oligomerization. Alpha olefins with the same attributes as those preferred for the first oligomerization are preferred for the subsequent oligomerization. Typically ratios for the intermediate PAO dimer fraction to the alpha olefins fraction in the feedstock are from 90:10 to 10:90 and more usually 80:20 to 20:80 by weight. But preferably the intermediate PAO dimer will make up around 50 mole % of the olefinic feed material since the properties and distribution of the final product, dependent in part upon the starting material, are favorably affected by feeding the intermediate PAO dimer at an equimolar ratio with the alpha olefins. Temperatures for the subsequent oligomerization in the second reactor range from 15 to 60° C.

Any oligomerization process and catalyst may be used for the subsequent oligomerization. A preferred catalyst for the subsequent oligomerization is a non-transition metal catalyst, and preferably a Lewis acid catalyst. Patent applications US 2009/0156874 and US 2009/0240012 describe a preferred process for the subsequent oligomerization, to which reference is made for details of feedstocks, compositions, catalysts and co-catalysts, and process conditions. The Lewis acid catalysts of US 2009/0156874 and US 2009/0240012 include the metal and metalloid halides conventionally used as Friedel-Crafts catalysts, examples include $AlCl_3$, $BF_3$, $AlBr_3$, $TiCl_3$, and $TiCl_4$ either alone or with a protic promoter/activator. Boron trifluoride is commonly used but not particularly suitable unless it is used with a protic promoter. Useful co-catalysts are well known and described in detail in US 2009/0156874 and US 2009/0240012. Solid Lewis acid catalysts, such as synthetic or natural zeolites, acid clays, polymeric acidic resins, amorphous solid catalysts such as silica-alumina, and heteropoly acids such as the tungsten zirconates, tungsten molybdates, tungsten vanadates, phosphotungstates and molybdotungstovanadogermanates (e.g., $WOx/ZrO_2$, $WOx/MoO_3$) may also be used although these are not generally as favored economically. Additional process conditions and other details are described in detail in US 2009/0156874 and US 2009/0240012, and incorporated herein by reference.

In a preferred embodiment, the subsequent oligomerization occurs in the presence of $BF_3$ and at least two different activators selected from alcohols and alkyl acetates. The alcohols are $C_1$ to $C_{10}$ alcohols and the alkyl acetates are $C_1$ to $C_{10}$ alkyl acetates. Preferably, both co-activators are $C_1$ to $C_6$ based compounds. Two most preferred combination of co-activators are i) ethanol and ethyl acetate and ii) n-butanol and n-butyl acetate. The ratio of alcohol to alkyl acetate range from 0.2 to 15, or preferably 0.5 to 7.

The structure of the invented intermediate PAO is such that, when reacted in a subsequent oligomerization, the intermediate PAO reacts preferentially with the optional LAO to form a co-dimer of the dimer and LAO at high yields. This allows for high conversion and yield rates of the desired PAO products. In an embodiment, the PAO product from the subsequent oligomerization comprises primarily a co-dimer of the dimer and the respective LAO feedstock. In an embodiment, where the LAO feedstock for both oligomerization steps is 1-decene, the incorporation of intermediate $C_{20}$ PAO dimer into higher oligomers is greater than 80%, the conversion of the LAO is greater than 95%, and the yield % of $C_{30}$ product in the overall product mix is greater than 75%. In another embodiment, where the LAO feedstock is 1-octene, the incorporation of the intermediate PAO dimer into higher oligomers is greater than 85%, the conversion of the LAO is greater than 90%, and the yield % of $C_{28}$ product in the overall product mix is greater than 70%. In another embodiment, where the feedstock is 1-dodecene, the incorporation of the intermediate PAO dimer into higher oligomers is greater than 90%, the conversion of the LAO is greater than 75%, and the yield % of $C_{32}$ product in the overall product mix is greater than 70%.

In an embodiment, the monomer is optional as a feedstock in the second reactor. In another embodiment, the first reactor effluent comprises unreacted monomer, and the unreacted monomer is fed to the second reactor. In another embodiment, monomer is fed into the second reactor, and the monomer is an LAO selected from the group including 1-hexene, 1-octene, 1-nonene, 1-decene, 1-dodecene, and 1-tetradecene. In another embodiment, the PAO produced in the subsequent oligomerization is derived from the intermediate PAO dimer plus only one monomer. In another embodiment, the PAO produced in the subsequent oligomerization is derived from the intermediate PAO dimer plus two or more monomers, or three or more monomers, or four or more monomers, or even five or more monomers. For example, the intermediate PAO dimer plus a $C_8$, $C_{10}$, $C_{12}$-LAO mixture, or a $C_6$, $C_8$, $C_9$, $C_{10}$, $C_{11}$, $C_{12}$, $C_{13}$, $C_{14}$-LAO mixture, or a $C_4$, $C_6$, $C_8$, $C_{10}$, $C_{12}$, $C_{14}$, $C_{16}$, $C_{18}$-LAO mixture can be used as a feed. In another embodiment, the PAO produced in the subsequent oligomerization comprises less than 30 mole % of $C_2$, $C_3$ and $C_4$ monomers, preferably less than 20 mole %, preferably less than 10 mole %, preferably less than 5 mole %, preferably less than 3 mole %, and preferably 0 mole %. Specifically, in another embodiment, the PAO produced in the subsequent oligomerization comprises less than 30 mole % of ethylene, propylene and butene, preferably less than 20 mole %, preferably less than 10 mole %, preferably less than 5 mole %, preferably less than 3 mole %, preferably 0 mole %.

The PAOs produced in the subsequent oligomerization may be a mixture of dimers, trimers, and optionally tetramer and higher oligomers. This PAO is referred to interchangeably as the "second reactor effluent" from which unreacted monomer may be optionally removed and recycled back to the second reactor. The desirable properties of the intermediate PAO dimer enable a high yield of a co-dimer of intermediate PAO dimer and LAO in the second reactor effluent. The PAOs in the second reactor effluent are especially notable because very low viscosity PAOs are achieved at very high yields and these PAOs have excellent rheological properties, including low pour point, outstanding Noack volatility, and very high viscosity indexes.

In an embodiment, this PAO may contain trace amounts of transition metal compound if the catalyst in the intermediate or subsequent oligomerization is a metallocene catalyst. A trace amount of transition metal compound is defined for purposes of this disclosure as any amount of transition metal compound or Group 4 metal present in the PAO. Presence of Group 4 metal may be detected at the ppm or ppb level by ASTM 5185 or other methods known in the art.

Preferably, the second reactor effluent PAO has a portion having a carbon count of $C_{28}$-$C_{32}$, wherein the $C_{28}$-$C_{32}$ portion is at least 65 wt %, preferably at least 70 wt %, preferably at least 75 wt %, more preferably at least 80 wt % of the second reactor effluent.

The kinematic viscosity at 100° C. of the PAO is less than 10 cSt, preferably less than 6 cSt, preferably less than 4.5 cSt, preferably less than 3.2 cSt, or preferably in the range of 2.8 to 4.5 cSt. The kinematic viscosity at 100° C. of the $C_{28}$ portion of the PAO is less than 3.2 cSt. In an embodiment, the kinematic viscosity at 100° C. of the $C_{28}$ to $C_{32}$ portion of the PAO is less than 10 cSt, preferably less than 6 cSt, preferably less than 4.5 cSt, and preferably in the range of 2.8 to 4.5 cSt.

In an embodiment, the pour point of the PAO is below −40° C., preferably below −50° C., preferably below −60° C., preferably below −70° C., or preferably below −80° C. The pour point of the $C_{28}$ to $C_{32}$ portion of the PAO is below −30° C., preferably below −40° C., preferably below −50° C., preferably below −60° C., preferably below −70° C., or preferably below −80° C.

The Noack volatility of the PAO is not more than 9.0 wt %, preferably not more than 8.5 wt %, preferably not more than 8.0 wt %, or preferably not more than 7.5 wt %. The Noack volatility of the $C_{28}$ to $C_{32}$ portion of the PAO is less than 19 wt %, preferably less than 14 wt %, preferably less than 12 wt %, preferably less than 10 wt %, or more preferably less than 9 wt %.

The viscosity index of the PAO is more than 121, preferably more than 125, preferably more than 130, or preferably more than 136. The viscosity index of the trimer or $C_{28}$ to $C_{32}$ portion of the PAO is above 120, preferably above 125, preferably above 130, or more preferably at least 135.

The cold crank simulator value (CCS) at −25° C. of the PAO or a portion of the PAO is not more than 500 cP, preferably not more than 450 cP, preferably not more than 350 cP, preferably not more than 250 cP, preferably in the range of 200 to 450 cP, or preferably in the range of 100 to 250 cP.

In an embodiment, the PAO has a kinematic viscosity at 100° C. of not more than 3.2 cSt and a Noack volatility of not more than 19 wt %. In another embodiment, the PAO has a kinematic viscosity at 100° C. of not more than 4.1 cSt and a Noack volatility of not more than 9 wt %.

The ability to achieve such low viscosity PAOs with such low Noack volatility at such high yields is especially remarkable, and highly attributable to the intermediate PAO tri-substituted vinylene dimer having properties that make it especially desirable in the subsequent oligomerization process.

The overall reaction scheme enabled by the present invention may be represented as shown below, starting from the original LAO feed and passing through the intermediate PAO dimer used as the feed for the subsequent oligomerization.

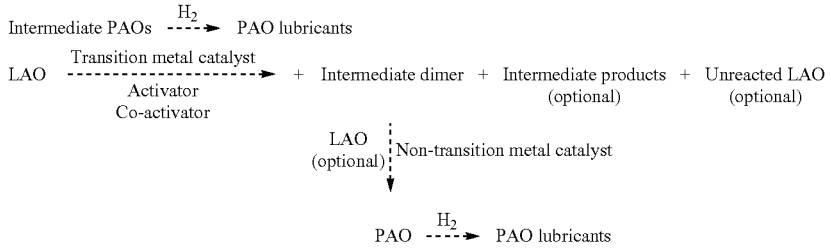

The lube range oligomer product from the subsequent oligomerization is desirably hydrogenated prior to use as a lubricant basestock to remove any residual unsaturation and stabilize the product. Optional hydrogenation may be carried out in the manner conventional to the hydrotreating of conventional PAOs. Prior to any hydrogenation, the PAO is comprised of at least 10 wt % of tetra-substituted olefins; as determined via carbon NMR (described later herein); in other embodiments, the amount of tetra-substitution is at least 15 wt %, or at least 20 wt % as determined by carbon NMR. The tetra-substituted olefin has the following structure:

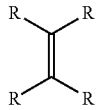

Additionally, prior to any hydrogenation, the PAO is comprised of at least 60 wt % tri-substituted olefins, preferably at least 70 wt % tri-substituted olefins.

The intermediate PAOs and second reactor PAOs produced, particularly those of ultra-low viscosity, are especially suitable for high performance automotive engine oil formulations either by themselves or by blending with other fluids, such as Group II, Group II+, Group III, Group III+ or lube basestocks derived from hydroisomerization of wax fractions from Fisher-Tropsch hydrocarbon synthesis from $CO/H_2$ syn gas, or other Group IV or Group V basestocks. They are also preferred grades for high performance industrial oil formulations that call for ultra-low and low viscosity oils. Additionally, they are also suitable for use in personal care applications, such as soaps, detergents, creams, lotions, sticks, shampoos, detergents, etc.

Lubricant Formulation

The lubricating oil compositions of the present disclosure are preferably formulated to be engine oil compositions. As such, the compositions preferably contain one or more additives as described below. The lubricating oil compositions, however, are not limited by the examples shown herein as illustrations.

Detergents

Detergents are commonly used in lubricating compositions, and especially in engine oil compositions. A typical detergent is an anionic material that contains a long chain hydrophobic portion of the molecule and a smaller anionic or oleophobic hydrophilic portion of the molecule. The anionic portion of the detergent is typically derived from an organic acid such as a sulfur acid, carboxylic acid, phosphorous acid, phenol, or mixtures thereof. The counterion is typically an alkaline earth or alkali metal.

Salts that contain a substantially stoichiometric amount of the metal are described as neutral salts and have a total base number (TBN, as measured by ASTM D2896) of from 0 to 80 mgKOHH/g. Many compositions are overbased, containing large amounts of a metal base that is achieved by reacting an excess of a metal compound (a metal hydroxide or oxide, for example) with an acidic gas (such as carbon dioxide). Useful detergents can be neutral, mildly overbased, or highly overbased.

It is desirable for at least some detergent to be overbased. Overbased detergents help neutralize acidic impurities produced by the combustion process and become entrapped in the oil. Typically, the overbased material has a ratio of metallic ion to anionic portion of the detergent of about 1.05:1 to 50:1 on an equivalent basis. More preferably, the ratio is from about 4:1 to about 25:1. The resulting detergent is an overbased detergent that will typically have a TBN of about 150 mgKOH/g or higher, often about 250 to 450 mgKOH/g or more. Preferably, the overbasing cation is sodium, calcium, or magnesium. A mixture of detergents of differing TBN can be used in the present invention.

Preferred detergents include the alkali or alkaline earth metal salts of sulfonates, phenates, carboxylates, phosphates, and salicylates.

Sulfonates may be prepared from sulfonic acids that are typically obtained by sulfonation of alkyl substituted aromatic hydrocarbons. Hydrocarbon examples include those obtained by alkylating benzene, toluene, xylene, naphthalene, biphenyl and their halogenated derivatives (chlorobenzene, chlorotoluene, and chloronaphthalene, for example). The alkylating agents typically have about 3 to 70 carbon atoms. The alkaryl sulfonates typically contain about 9 to about 80 carbon or more carbon atoms, more typically from about 16 to 60 carbon atoms.

Klamann in Lubricants and Related Products, op cit discloses a number of overbased metal salts of various sulfonic acids which are useful as detergents and dispersants in lubricants. The book entitled "Lubricant Additives", C. V. Smallheer and R. K. Smith, published by the Lezius-Hiles Co. of Cleveland, Ohio (1967), similarly discloses a number of overbased sulfonates that are useful as dispersants/detergents.

Alkaline earth phenates are another useful class of detergent. These detergents can be made by reacting alkaline earth metal hydroxide or oxide (CaO, $Ca(OH)_2$, BaO, $Ba(OH)_2$, MgO, $Mg(OH)_2$, for example) with an alkyl phenol or sulfurized alkylphenol. Useful alkyl groups include straight chain or branched $C_1$-$C_{30}$ alkyl groups, preferably, $C_4$-$C_{20}$. Examples of suitable phenols include isobutylphenol, 2-ethylhexylphenol, nonylphenol, dodecyl phenol, and the like. It should be noted that starting alkylphenols may contain more than one alkyl substituent that are each independently straight chain or branched. When a non-sulfurized alkylphenol is used, the sulfurized product may be obtained by methods well known in the art. These methods include heating a mixture of alkylphenol and sulfurizing agent (including elemental sulfur, sulfur halides such as sulfur dichloride, and the like) and then reacting the sulfurized phenol with an alkaline earth metal base.

Metal salts of carboxylic acids are also useful as detergents. These carboxylic acid detergents may be prepared by reacting a basic metal compound with at least one carboxylic acid and removing free water from the reaction product. These compounds may be overbased to produce the desired TBN level. Detergents made from salicylic acid are one preferred class of detergents derived from carboxylic acids. Useful salicylates include long chain alkyl salicylates. One useful family of compositions is of the formula

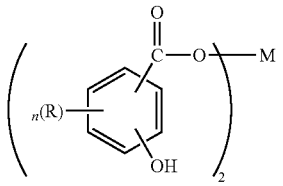

where R is a hydrogen atom or an alkyl group having 1 to about 30 carbon atoms, n is an integer from 1 to 4, and M is an alkaline earth metal. Preferred R groups are alkyl chains of at least $C_{11}$, preferably $C_{13}$ or greater. R may be optionally substituted with substituents that do not interfere with the detergent's function. M is preferably, calcium, magnesium, or barium. More preferably, M is calcium.

Hydrocarbyl-substituted salicylic acids may be prepared from phenols by the Kolbe reaction. See U.S. Pat. No. 3,595,791 for additional information on synthesis of these compounds. The metal salts of the hydrocarbyl-substituted salicylic acids may be prepared by double decomposition of a metal salt in a polar solvent such as water or alcohol.

Alkaline earth metal phosphates are also used as detergents.

Detergents may be simple detergents or what is known as hybrid or complex detergents. The latter detergents can provide the properties of two detergents without the need to blend separate materials. See U.S. Pat. No. 6,034,039 for example.

Preferred detergents include calcium phenates, calcium sulfonates, calcium salicylates, magnesium phenates, magnesium sulfonates, magnesium salicylates and other related components (including borated detergents). Typically, the total detergent concentration is about 0.01 to about 8.0 wt %, preferably, about 0.1 to 4.0 wt %. Preferably the combined concentration of Ca and Mg in the engine oil composition, when one or both are present, is at least 0.05 wt % of the composition, more preferably at least 0.08 wt % of the composition, most preferably at least 0.10 wt % of the composition. Preferably, the TBN of the engine oil composition is at least 6.0 mgKOH/g, more preferably at least 7.0 mgKOH/g, most preferably at least 8.0 mgKOH/g, as determined ASTM D2896.

Dispersants

During engine operation, oil-insoluble oxidation byproducts are produced. Dispersants help keep these byproducts in solution, thus diminishing their deposition on metal surfaces. Dispersants may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents discussed above form ash upon combustion.

Suitable dispersants typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Chemically, many dispersants may be characterized as phenates, sulfonates, sulfurized phenates, salicylates, naphthenates, stearates, carbamates, thiocarbamates, phosphorus derivatives. A particularly useful class of dispersants are the alkenylsuccinic derivatives, typically produced by the reaction of a long chain substituted alkenyl succinic compound, usually a substituted succinic anhydride, with a polyhydroxy or polyamino compound. The long chain group constituting the oleophilic portion of the molecule which confers solubility in the oil, is normally a polyisobutylene group. Many examples of this type of dispersant are well known commercially and in the literature. Exemplary U.S. patents describing such dispersants are U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. A further description of dispersants may be found, for example, in European Patent Application No. 471 071, to which reference is made for this purpose.

Hydrocarbyl-substituted succinic acid compounds are popular dispersants. In particular, succinimide, succinate esters, or succinate ester amides prepared by the reaction of a hydrocarbon-substituted succinic acid compound preferably having at least 50 carbon atoms in the hydrocarbon substituent, with at least one equivalent of an alkylene amine are particularly useful.

Succinimides are formed by the condensation reaction between alkenyl succinic anhydrides and amines. Molar ratios can vary depending on the polyamine. For example, the molar ratio of alkenyl succinic anhydride to TEPA can vary from about 1:1 to about 5:1. Representative examples are shown in U.S. Pat. Nos. 3,087,936; 3,172,892; 3,219,666; 3,272,746; 3,322,670; and 3,652,616, 3,948,800; and Canada Pat. No. 1,094,044.

Succinate esters are formed by the condensation reaction between alkenyl succinic anhydrides and alcohols or polyols. Molar ratios can vary depending on the alcohol or polyol used. For example, the condensation product of an alkenyl succinic anhydride and pentaerythritol is a useful dispersant.

Succinate ester amides are formed by condensation reaction between alkenyl succinic anhydrides and alkanol amines. For example, suitable alkanol amines include ethoxylated polyalkylpolyamines, propoxylated polyalkylpolyamines and polyalkenylpolyamines such as polyethylene polyamines. One example is propoxylated hexamethylenediamine. Representative examples are shown in U.S. Pat. No. 4,426,305.

The molecular weight of the alkenyl succinic anhydrides used in the preceding paragraphs will typically range between 800 and 2,500. The above products can be post-reacted with various reagents such as sulfur, oxygen, formaldehyde, carboxylic acids such as oleic acid, and boron compounds such as borate esters or highly borated dispersants. The dispersants can be borated with from about 0.1 to about 5 moles of boron per mole of dispersant reaction product.

Mannich base dispersants are made from the reaction of alkylphenols, formaldehyde, and amines. See U.S. Pat. No. 4,767,551. Process aids and catalysts, such as oleic acid and sulfonic acids, can also be part of the reaction mixture. Molecular weights of the alkylphenols range from 800 to 2,500. Representative examples are shown in U.S. Pat. Nos. 3,697,574; 3,703,536; 3,704,308; 3,751,365; 3,756,953; 3,798,165; and 3,803,039.

Typical high molecular weight aliphatic acid modified Mannich condensation products useful in this invention can be prepared from high molecular weight alkyl-substituted hydroxyaromatics or $HN(R)_2$ group-containing reactants.

Examples of high molecular weight alkyl-substituted hydroxyaromatic compounds are polypropylphenol, polybutylphenol, and other polyalkylphenols. These polyalkylphenols can be obtained by the alkylation, in the presence of an alkylating catalyst, such as $BF_3$, of phenol with high molecular weight polypropylene, polybutylene, and other polyalkylene compounds to give alkyl substituents on the benzene ring of phenol having an average 600-100,000 molecular weight.

Examples of HN(R) 2 group-containing reactants are alkylene polyamines, principally polyethylene polyamines. Other representative organic compounds containing at least one $HN(R)_2$ group suitable for use in the preparation of Mannich condensation products are well known and include the mono- and di-amino alkanes and their substituted analogs, e.g., ethylamine and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

Examples of alkylene polyamide reactants include ethylenediamine, diethylene triamine, triethylene tetraamine, tetraethylene pentaamine, pentaethylene hexamine, hexaethylene heptaamine, heptaethylene octaamine, octaethylene nonaamine, nonaethylene decamine, and decaethylene undecamine and mixture of such amines having nitrogen contents corresponding to the alkylene polyamines, in the formula $H_2N—(Z—NH—)_nH$, mentioned before, Z is a divalent ethylene and n is 1 to 10 of the foregoing formula. Corresponding propylene polyamines such as propylene diamine and di-, tri-, tetra-, penta-propylene tri-, tetra-, penta- and hexaamines are also suitable reactants. The alkylene polyamines are usually obtained by the reaction of ammonia and dihalo alkanes, such as dichloro alkanes. Thus the alkylene polyamines obtained from the reaction of 2 to 11 moles of ammonia with 1 to 10 moles of dichloroalkanes having 2 to 6 carbon atoms and the chlorines on different carbons are suitable alkylene polyamine reactants.

Aldehyde reactants useful in the preparation of the high molecular products useful in this invention include the aliphatic aldehydes such as formaldehyde (also as paraformaldehyde and formalin), acetaldehyde and aldol (3-hydroxybutyraldehyde). Formaldehyde or a formaldehyde-yielding reactant is preferred.

Hydrocarbyl substituted amine ashless dispersant additives are well known to one skilled in the art; see, for example, U.S. Pat. Nos. 3,275,554; 3,438,757; 3,565,804; 3,755,433; 3,822,209 and 5,084,197.

Preferred dispersants include borated and non-borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 500 to about 5000 or a mixture of such hydrocarbylene groups. Other preferred dispersants include succinic acid-esters and amides, alkylphenol-polyamine-coupled Mannich adducts, their capped derivatives, and other related components. Such additives may be used in an amount of about 0.1 to 20 wt %, preferably about 0.1 to 8 wt %.

Antiwear and EP Additives

Many lubricating oils require the presence of antiwear and/or extreme pressure (EP) additives in order to provide adequate antiwear protection for the engine. Increasingly, specifications for engine oil performance have exhibited a trend for improved antiwear properties of the oil. Antiwear and extreme EP additives perform this role by reducing friction and wear of metal parts.

While there are many different types of antiwear additives, for several decades the principal antiwear additive for internal combustion engine crankcase oils is a metal alkylthiophosphate and more particularly a metal dialkyldithiophosphate in which the primary metal constituent is zinc, or zinc dialkyldithiophosphate (ZDDP). ZDDP compounds generally are of the formula $Zn[SP(S)(OR^1)(OR^2)]_2$ where $R^1$ and $R^2$ are $C_1$-$C_{18}$ alkyl groups, preferably $C_2$-$C_{12}$ alkyl groups. These alkyl groups may be straight chain or branched. The ZDDP is typically used in amounts of from about 0.4 to 1.4 wt % of the total lube oil composition, although more or less can often be used advantageously.

ZDDP can be combined with other compositions that provide antiwear properties. U.S. Pat. No. 5,034,141 discloses that a combination of a thiodixanthogen compound (octylthiodixanthogen, for example) and a metal thiophosphate (ZDDP, for example) can improve antiwear properties. U.S. Pat. No. 5,034,142 discloses that use of a metal alkyoxyalkylxanthate (nickel ethoxyethylxanthate, for example) and a dixanthogen (diethoxyethyl dixanthogen, for example) in combination with ZDDP improves antiwear properties.

A variety of non-phosphorous additives can also be used as antiwear additives. Sulfurized olefins are useful as antiwear and EP additives. Sulfur-containing olefins can be prepared by sulfurization of various organic materials including aliphatic, arylaliphatic or alicyclic olefinic hydrocarbons containing from about 3 to 30 carbon atoms, preferably 3-20 carbon atoms. The olefinic compounds contain at least one non-aromatic double bond. Such compounds are defined by the formula $$R^3R^4C{=}CR^5R^6$$

where each of $R^3$-$R^6$ are independently hydrogen or a hydrocarbon radical. Preferred hydrocarbon radicals are alkyl or alkenyl radicals. Any two of $R^3$-$R^6$ may be connected so as to form a cyclic ring. Additional information concerning sulfurized olefins and their preparation can be found in U.S. Pat. No. 4,941,984.

The use of polysulfides of thiophosphorus acids and thiophosphorus acid esters as lubricant additives is disclosed in U.S. Pat. Nos. 2,443,264; 2,471,115; 2,526,497; and 2,591,577. Addition of phosphorothionyl disulfides as an antiwear, antioxidant, and EP additive is disclosed in U.S. Pat. No. 3,770,854. Use of alkylthiocarbamoyl compounds (bis(dibutyl)thiocarbamoyl, for example) in combination with a molybdenum compound (oxymolybdenum diisopropylphosphorodithioate sulfide, for example) and a phosphorous ester (dibutyl hydrogen phosphite, for example) as antiwear additives in lubricants is disclosed in U.S. Pat. No. 4,501,678. U.S. Pat. No. 4,758,362 discloses use of a carbamate additive to provide improved antiwear and extreme pressure properties. The use of thiocarbamate as an antiwear additive is disclosed in U.S. Pat. No. 5,693,598. Thiocarbamate/molybdenum complexes such as moly-sulfur alkyl dithiocarbamate trimer complex (R=$C_8$-$C_{18}$ alkyl) are also useful antiwear agents. The use or addition of such materials should be kept to a minimum if the object is to produce low SAP formulations.

Esters of glycerol may be used as antiwear agents. For example, mono-, di-, and tri-oleates, mono-palmitates and mono-myristates may be used.

Preferred antiwear additives include phosphorus and sulfur compounds such as zinc dithiophosphates and/or sulfur, nitrogen, boron, molybdenum phosphorodithioates, molybdenum dithiocarbamates and various organo-molybdenum derivatives including heterocyclics, for example dimercaptothiadiazoles, mercaptobenzothiadiazoles, triazines, and the like, alicyclics, amines, alcohols, esters, diols, triols, fatty amides and the like can also be used. Such additives may be used in an amount of about 0.01 to 6 wt %, preferably about 0.01 to 4 wt %. ZDDP-like compounds provide limited hydroperoxide decomposition capability, significantly below that exhibited by compounds disclosed and claimed in this patent and can therefore be eliminated from the formulation or, if retained, kept at a minimal concentration to facilitate production of low SAP formulations.

Friction Modifiers

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, lubricant compositions, or functional fluids, to modify the coefficient of friction of a lubricated surface may be effectively used in combination with the base oils or lubricant compositions of the present invention if desired. Friction modifiers that lower the coefficient of friction are particularly advantageous in combination with the base oils and lube compositions of this invention. Friction modifiers may include metal-containing compounds or materials as well as ashless compounds or materials, or mixtures thereof. Metal-containing friction modifiers may include metal salts or metal-ligand complexes where the metals may include alkali, alkaline earth, or transition group metals. Such metal-containing friction modifiers may also have low-ash characteristics. Transition metals may include Mo, Sb, Sn, Fe, Cu, Zn, and others. Ligands may include hydrocarbyl derivative of alcohols, polyols, glycerols, partial ester glycerols, thiols, carboxylates, carbamates, thiocarbamates, dithiocarbamates, phosphates, thiophosphates, dithiophosphates, amides, imides, amines, thiazoles, thiadiazoles, dithiazoles, diazoles, triazoles, and other polar molecular functional groups containing effective amounts of O, N, S, or P, individually or in combination. In particular, Mo-containing compounds can be particularly effective such as for example Mo-dithiocarbamates, Mo(DTC), Mo-dithiophosphates, Mo(DTP), Mo-amines, Mo (Am), Mo-alcoholates, Mo-alcohol-amides, etc. See U.S. Pat. No. 5,824,627; U.S. Pat. No. 6,232,276; U.S. Pat. No. 6,153,564; U.S. Pat. No. 6,143,701; U.S. Pat. No. 6,110,878; U.S. Pat. No. 5,837,657; U.S. Pat. No. 6,010,987; U.S. Pat. No. 5,906,968; U.S. Pat. No. 6,734,150; U.S. Pat. No. 6,730,638; U.S. Pat. No. 6,689,725; U.S. Pat. No. 6,569,820; WO 99/66013; WO 99/47629; WO 98/26030.

Ashless friction modifiers may include lubricant materials that contain effective amounts of polar groups, for example, hydroxyl-containing hydrocarbyl base oils, glycerides, partial glycerides, glyceride derivatives, and the like. Polar groups in friction modifiers may include hydrocarbyl groups containing effective amounts of O, N, S, or P, individually or in combination. Other friction modifiers that may be particularly effective include, for example, salts (both ash-containing and ashless derivatives) of fatty acids, fatty alcohols, fatty amides, fatty esters, hydroxyl-containing carboxylates, and comparable synthetic long-chain hydrocarbyl acids, alcohols, amides, esters, hydroxy carboxylates, and the like. In some instances fatty organic acids, fatty amines, and sulfurized fatty acids may be used as suitable friction modifiers.

Useful concentrations of friction modifiers may range from about 0.01 wt % to 10-15 wt % or more, often with a preferred range of about 0.1 wt % to 5 wt %. Concentrations of molybdenum-containing materials are often described in terms of Mo metal concentration. Advantageous concentrations of Mo may range from about 10 ppm to 3000 ppm or more, and often with a preferred range of about 20-2000 ppm, and in some instances a more preferred range of about 30-1000 ppm. Friction modifiers of all types may be used alone or in mixtures with the materials of this invention. Often mixtures of two or more friction modifiers, or mixtures of friction modifier(s) with alternate surface active material(s), are also desirable.

Antioxidants

Antioxidants retard the oxidative degradation of base oils during service. Such degradation may result in deposits on metal surfaces, the presence of sludge, or a viscosity increase in the lubricant. One skilled in the art knows a wide variety of oxidation inhibitors that are useful in lubricating oil compositions. See, Klamann in Lubricants and Related Products, op cit, and U.S. Pat. Nos. 4,798,684 and 5,084,197, for example.

Useful antioxidants include hindered phenols. These phenolic antioxidants may be ashless (metal-free) phenolic compounds or neutral or basic metal salts of certain phenolic compounds. Typical phenolic antioxidant compounds are the hindered phenolics which are the ones which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_6$+ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include for example hindered 2,6-di-alkyl-phenolic proprionic ester derivatives. Bis-phenolic antioxidants may also be advantageously used in combination with the instant invention. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4, 4'-bis(2,6-di-t-butyl phenol) and 4,4'-methylene-bis(2,6-di-t-butyl phenol).

Non-phenolic oxidation inhibitors which may be used include aromatic amine antioxidants and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is a higher alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present invention include: p,p'-dioctyldiphenylamine; t-octylphenyl-alpha-naphthylamine; phenyl-alphanaphthylamine; and p-octylphenyl-alpha-naphthylamine.

Sulfurized alkyl phenols and alkali or alkaline earth metal salts thereof also are useful antioxidants.

Another class of antioxidant used in lubricating oil compositions is oil-soluble copper compounds. Any oil-soluble suitable copper compound may be blended into the lubricating oil. Examples of suitable copper antioxidants include copper dihydrocarbyl thio- or dithio-phosphates and copper salts of carboxylic acid (naturally occurring or synthetic). Other suitable copper salts include copper dithiacarbamates, sulphonates, phenates, and acetylacetonates. Basic, neutral, or acidic copper Cu(I) and or Cu(II) salts derived from alkenyl succinic acids or anhydrides are known to be particularly useful.

Preferred antioxidants include hindered phenols, arylamines. These antioxidants may be used individually by type or in combination with one another. Such additives may be used in an amount of about 0.01 to 5 wt %, preferably about 0.01 to 3 wt %, more preferably 0.1 to 2.0 wt.

Pour Point Depressants

Conventional pour point depressants (also known as lube oil flow improvers) may be added to the compositions of the present invention if desired. These pour point depressants may be added to lubricating compositions of the present invention to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, and terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666746; 2,721,877; 2,721,878; and 3,250,715 describe useful pour point depressants and/or the preparation thereof. Such additives may be used in an amount of about 0.01 to 5 wt %, preferably about 0 to 1.5 wt %.

Anti-Foam Agents

Anti-foam agents may advantageously be added to lubricant compositions. These agents retard the formation of stable foams. Silicones and organic polymers are typical anti-foam agents. For example, polysiloxanes, such as silicon oil or polydimethyl siloxane, provide antifoam properties. Anti-foam agents are commercially available and may be used in conventional minor amounts along with other additives such as demulsifiers; usually the amount of these additives combined is less than 1 percent and often less than 0.2 percent.

Antirust Additives and Corrosion Inhibitors

Antirust additives (or corrosion inhibitors) are additives that protect lubricated metal surfaces against chemical attack by water or other contaminants. A wide variety of these are commercially available; they are referred to in Klamann in Lubricants and Related Products, op cit.

One type of antirust additive is a polar compound that wets the metal surface preferentially, protecting it with a film of oil. Another type of antirust additive absorbs water by incorporating it in a water-in-oil emulsion so that only the oil touches the metal surface. Yet another type of antirust additive chemically adheres to the metal to produce a non-reactive surface. Examples of suitable additives include zinc dithiophosphates, metal phenolates, basic metal sulfonates, fatty acids and amines. Other examples include thiadiazoles. See, for example, U.S. Pat. Nos. 2,719,125; 2,719,126; and 3,087,932. Such additives may be used in an amount of about 0 to 5 wt %, preferably about 0 to 1.5 wt %.

Seal Compatibility Additives

Seal compatibility agents help to swell elastomeric seals by causing a chemical reaction in the fluid or physical change in the elastomer. Suitable seal compatibility agents for lubricating oils include organic phosphates, aromatic esters, aromatic hydrocarbons, esters (butylbenzyl phthalate, for example), and polybutenyl succinic anhydride. Such additives may be used in an amount of about 0.01 to 3 wt %, preferably about 0.01 to 2 wt %.

Viscosity Improvers

Viscosity improvers (also known as Viscosity Index modifiers, and VI improvers) provide lubricants with high and low temperature operability. These additives increase the viscosity of the oil composition at elevated temperatures which increases film thickness, while having limited effect on viscosity at low temperatures. In the engine oil compositions of the present invention, VI improvers are not necessarily used, but may be used in an amount up to about 0.25 wt % of the composition, on a solid polymer basis.

Suitable viscosity improvers include high molecular weight hydrocarbons, polyesters and viscosity index improver dispersants that function as both a viscosity index improver and a dispersant. Typical molecular weights of these polymers are between about 1,000 to 1,000,000, more typically about 25,000 to 500,000, and even more typically about 50,000 to 400,000. Typical viscosity improvers have a shear stability index (SSI) of about 4 to 65.

Examples of suitable viscosity improvers are polymers and copolymers of methacrylate, butadiene, olefins, or alkylated styrenes. Polyisobutylene is a commonly used viscosity index improver. Other suitable viscosity index improvers are polymethacrylates (copolymers of various chain length alkyl methacrylates, for example) and polyacrylates (copolymers of various chain length acrylates, for example).

Other suitable viscosity index improvers include copolymers of ethylene and propylene and copolymers of propylene and butylene. Such copolymers typically have molecular weights of 100,000 to 400,000.

Hydrogenated block copolymers of styrene and isoprene can also be used. Specific examples include styrene-isoprene or styrene-butadiene based polymers of 50,000 to 200,000 molecular weight.

Co-Basestocks

In lubricating oil compositions of the present invention, the lubricating oil compositions also include between and 0.1 wt % to 20 wt % of a second base oil component, consisting of a Group II, Group III or Group V base stock (such as alkylated naphthalenes and esters), or any combination thereof. These co-base stocks can provide increased solubility of the additives in the composition.

Group II base stocks contain greater than or equal to 90 percent saturates; less than or equal to 0.03 percent sulfur; and a viscosity index greater than or equal to 80 and less than 210. Manufacturing plants that make Group II base stocks typically employ hydroprocessing such as hydrocracking or severe hydrotreating to increase the VI of the crude oil to the specifications value. The use of hydroprocessing typically increases the saturate content above 90% and reduces the sulfur below 300 ppm. Group II base stocks useful in the current inventions have a kinematic viscosity at 100° C. of about 2 to 14 cSt.

Group III base stocks contain greater than or equal to 90 percent saturates; less than or equal to 0.03 percent sulfur; and a viscosity index greater than or equal to 120. Group III base stocks are usually produced using a three-stage process involving hydrocracking an oil feed stock, such as vacuum gas oil, to remove impurities and to saturate all aromatics which might be present to produce highly paraffinic lube oil stock of very high viscosity index, subjecting the hydrocracked stock to selective catalytic hydrodewaxing which converts normal paraffins into branched paraffins by isomerization followed by hydrofinishing to remove any residual aromatics, sulfur, nitrogen or oxygenates. Group III base stocks useful in the current inventions have a kinematic viscosity at 100° C. of about 4 to 9 cSt.

Alkylated naphthalenes are a useful co-basestock. The alkyl groups on the alkylated naphthalene preferably have from about 6 to 30 carbon atoms, with particular preference to about 12 to 18 carbon atoms. A preferred class of alkylating agents are the olefins with the requisite number of carbon atoms, for example, the hexenes, heptenes, octenes, nonenes, decenes, undecenes, dodecenes. Mixtures of the olefins, e.g. mixtures of $C_{12}$-$C_{20}$ or $C_{14}$-$C_{18}$ olefins, are useful. Branched alkylating agents, especially oligomerized olefins such as the trimers, tetramers, pentamers, etc., of light olefins such as ethylene, propylene, the butylenes, etc., are also useful. Alklylated naphthalene base stocks useful in the current inventions have a kinematic viscosity at 100° C. of about 4 to 24 cSt.

Esters also comprise a useful co-basestock. Additive solvency and seal compatibility characteristics may be secured by the use of esters such as the esters of dibasic acids with monoalkanols and the polyol esters of monocarboxylic acids. Esters of the former type include, for example, the esters of dicarboxylic acids such as phthalic acid, succinic acid, alkyl succinic acid, alkenyl succinic acid, maleic acid, azelaic acid, suberic acid, sebacic acid, fumaric acid, adipic acid, linoleic acid dimer, malonic acid, alkyl malonic acid, alkenyl malonic acid, etc., with a variety of alcohols such as butyl alcohol, hexyl alcohol, dodecyl alcohol, 2-ethylhexyl alcohol, etc. Specific examples of these types of esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, etc.

Particularly useful synthetic esters are those full or partial esters which are obtained by reacting one or more polyhydric alcohols (preferably the hindered polyols such as the neopentyl polyols e.g. neopentyl glycol, trimethylol ethane, 2-methyl-2-propyl-1,3-propanediol, trimethylol propane, pentaerythritol and dipentaerythritol) with alkanoic acids containing at least about 4 carbon atoms (preferably $C_5$ to $C_{30}$ acids such as saturated straight chain fatty acids including caprylic acid, capric acid, lauric acid, myristic acid, palmitic acid, stearic acid, arachic acid, and behenic acid, or the corresponding branched chain fatty acids or unsaturated fatty acids such as oleic acid).

Suitable synthetic ester components include the esters of trimethylol propane, trimethylol butane, trimethylol ethane, pentaerythritol and/or dipentaerythritol with one or more monocarboxylic acids containing from about 5 to about 10 carbon atoms.

Ester base stocks useful in the current inventions have a kinematic viscosity at 100° C. of about 1 to 50 cSt.

Typical Additive Amounts

When lubricating oil compositions contain one or more of the additives discussed above, the additive(s) are blended into the composition in an amount sufficient for it to perform its intended function. Typical amounts of such additives useful in the present invention are shown in Table A below.

Note that many of the additives are shipped from the manufacturer and used with a certain amount of base oil solvent in the formulation. Accordingly, the weight amounts in the table below, as well as other amounts mentioned in this text, unless otherwise indicated are directed to the amount of active ingredient (that is the non-solvent portion of the ingredient). The wt % indicated below is based on the total weight of the lubricating oil composition.

TABLE A

Typical Amounts of Various Lubricant Oil Components

| Compound | Approximate wt % (useful) | Approximate wt % (preferred) |
|---|---|---|
| Detergents | 0.01-8 | 0.01-4 |
| Dispersants | 0.1-20 | 0.1-8 |
| Antiwear Additives | 0.01-6 | 0.01-4 |
| Friction Modifiers | 0.01-15 | 0.01-5 |
| Antioxidants | 0.01-5 | 0.1-2 |
| Pour Point Depressants | 0.01-5 | 0-1.5 |
| Anti-foam Agents | 0.001-1 | 0-0.2 |
| Corrosion Inhibitors | 0-5 | 0-1.5 |
| Viscosity Improvers (solid polymer basis) | 0-0.5 | 0-0.25 |
| Group II, Group III and/or Group V base stocks | 0.1-20 | 0.1-15 |
| Low viscosity PAO | Balance | Balance |

Engine oil compositions are prepared by blending together or admixing 60 wt % to 90 wt % of a first base oil component, based on the total weight of the composition, the first base oil component consisting of a polyalphaolefin base stock or combination of polyalphaolefin base stocks, each having a kinematic viscosity at 100° C. of from 3.2 cSt to 3.8 cSt; 0.1 wt % to 20 wt % of a second base oil component, based on the total weight of the composition, the second base oil component consisting of a Group II, Group III or Group V base stock, or any combination thereof; and from 0 wt % to less than 0.25 wt % viscosity index improver, on a solid polymer basis.

In an embodiment, the first base oil component consists of a polyalphaolefin base stock chosen from the group consisting of a metallocene-catalyzed polyalphaolefin base stock and a polyalphaolefin base stock obtained by a process for producing low viscosity polyalphaolefins having a carbon count of C28 to C32, said process comprising a first step that provides a tri-substituted vinylene intermediate polyalphaolefin dimer with metallocene catalysis, and a second step that provides a C28 to C32 polyalphaolefin trimer through addition of a monomer to the tri-substituted vinylene dimer, or any combination thereof.

In an embodiment, the first base oil component consists of a polyalphaolefin chosen from the group consisting of a metallocene-catalyzed polyalphaolefin base stock and a polyalphaolefin base stock obtained from a process comprising:

a. contacting a catalyst, an activator, and a monomer in a first reactor to obtain a first reactor effluent, the effluent comprising a dimer product, a trimer product, and optionally a higher oligomer product,
b. feeding at least a portion of the dimer product to a second reactor,
c. contacting said dimer product with a second catalyst, a second activator, and optionally a second monomer in the second reactor,
d. obtaining a second reactor effluent, the effluent comprising at least a trimer product, and
e. hydrogenating at least the trimer product of the second reactor effluent, wherein the dimer product of the first reactor effluent contains at least 25 wt % of tri-substituted vinylene represented by the following structure:

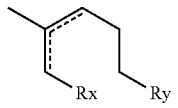

and the dashed line represents the two possible locations where the unsaturated double bond may be located and Rx and Ry are independently selected from a $C_3$ to $C_{21}$ alkyl group, or any combination thereof In an embodiment, the first reactor effluent contains less than 70 wt % of di-substituted vinylidene represented by the following formula:

$$RqRzC{=}CH_2$$

wherein Rq and Rz are independently selected from alkyl groups.

In an embodiment, the dimer product of the first reactor effluent contains greater than 50 wt % of tri-substituted vinylene dimer.

In an embodiment, the second reactor effluent has a product having a carbon count of C28-C32, wherein said product comprises at least 70 wt % of said second reactor effluent.

In an embodiment, the monomer contacted in the first reactor is comprised of at least one linear alpha olefin wherein the linear alpha olefin is selected from at least one of 1-hexene, 1-octene, 1-nonene, 1-decene, 1-dodecene, 1-tetradecene, and combinations thereof.

In an embodiment, monomer is fed into the second reactor, and the monomer is a linear alpha olefin selected from the group including 1-hexene, 1-octene, 1-nonene, 1-decene, 1-dodecene, and 1-tetradecene.

In an embodiment, the catalyst in the first reactor is represented by the following formula:

$$X_1X_2M_1(CpCp^*)M_2X_3X_4$$

wherein:

$M_1$ is an optional bridging element;

$M_2$ is a Group 4 metal;

Cp and Cp* are the same or different substituted or unsubstituted cyclopentadienyl ligand systems, or are the same or different substituted or unsubstituted indenyl or tetrahydroindenyl rings, wherein, if substituted, the substitutions may be independent or linked to form multicyclic structures;

$X_1$ and $X_2$ are independently hydrogen, hydride radicals, hydrocarbyl radicals, substituted hydrocarbyl radicals, silylcarbyl radicals, substituted silylcarbyl radicals, germylcarbyl radicals, or substituted germylcarbyl radicals; and $X_3$ and $X_4$ are independently hydrogen, halogen, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both $X_3$ and $X_4$ are joined and bound to the metal atom to form a metallacycle ring containing from about 3 to about 20 carbon atoms.

In an embodiment, the first step of contacting occurs by contacting the catalyst, activator system, and monomer wherein the catalyst is represented by the formula of $$X_1X_2M_1(CpCp^*)M_2X_3X_4$$

wherein:

M1 is a bridging element of silicon,

M2 is the metal center of the catalyst, and is preferably titanium, zirconium, or hafnium.

Cp and Cp* are the same or different substituted or unsubstituted indenyl or tetrahydroindenyl rings that are each bonded to both $M_1$ and $M_2$, and X1, X2, X3, and X4 or are preferably independently selected from hydrogen, branched or unbranched $C_1$ to $C_{20}$ hydrocarbyl radicals, or branched or unbranched substituted $C_1$ to $C_{20}$ hydrocarbyl radicals; and the activator system is a combination of an activator and co-activator, wherein the activator is a non-coordinating anion, and the co-activator is a tri-alkylaluminum compound wherein the alkyl groups are independently selected from C1 to C20 alkyl groups, wherein the molar ratio of activator to transition metal compound is in the range of 0.1 to 10 and the molar ratio of co-activator to transition metal compound is 1 to 1000, and the catalyst, activator, co-activator, and monomer are contacted in the absence of hydrogen, at a temperature of 80° C. to 150° C., and with a reactor residence time of 2 minutes to 6 hours.

In an embodiment, the second base oil component comprises a Group V base stock, such as an alkylated naphthalene base stock or an ester base stock.

The ultra-low viscosity (e.g., kinematic viscosity at 100° C. of from 4 cSt to 6 cSt) engine oil compositions demonstrate superior performance with regard to the combination of properties including Noack volatility, CCS viscosity and HTHS viscosity.

In one embodiment, no VI improvers are needed due to the high inherent VI of the base stocks. This benefit permits the ability to avoid VI improvers that may adversely affect shear stability of the engine oil composition. In another embodiment, less than 0.25 wt %, on a solid polymer basis, of VI improvers is used in the engine oil compositions.

In the engine oil compositions, the first base oil component can be used in an amount of from 60 wt % to 95 wt % of the composition, from 70 wt % to 95 wt % of the composition, from 80 wt % to 95 wt % of the composition, from 60 wt % to 90 wt % of the composition, from 70 wt % to 90 wt % of the composition, or from 80 wt % to 90 wt % of the composition.

In the engine oil compositions, the second base oil component can be used in an amount of from 0.1 wt % to 20 wt % of the composition, from 0.1 wt % to 15 wt % of the composition, from 0.1 wt % to 10 wt % of the composition, from 1 wt % to 20 wt % of the composition, from 1 wt % to 15 wt % of the composition, or from 1 wt % to 10 wt % of the composition.

The engine oil compositions have outstanding Noack volatilities, as determined by ASTM D5800. Preferably, the Noack volatility of the engine oil composition is less than wt % loss, less than 13 wt % loss, or less than 11 wt % loss.

The engine oil compositions have outstanding CCS viscosities at −35° C., as determined by ASTM D5293. Preferably, the CCS viscosity of the engine oil composition is less than 6200 mPa·s, less than 5000 mPa·s, less than 4000 mPa·s, less than 3500 mPa·s, less than 3000 mPa·s, less than 2500 mPa·s, less than 2000 mPa·s, or less than 1700 mPa·s.

The engine oil compositions have outstanding high-temperature, high-shear (HTHS) viscosities at 150° C., as determined by ASTM D4683. Preferably, the HTHS viscosity of the engine oil composition at 150° C. is less than 2.6 mPa·s, less than 2.3 mPa·s, less than 2.0 mPa·s, or less than 1.85 mPa·s.

The engine oil compositions preferably have outstanding deposit performance as measured by TEOST MHT-4 (ASTM D7097). Preferably, the deposits are less than 35 mg or less than 30 mg.

The engine oil compositions preferably have a total base number (TBN), as determined by ASTM D2896, of greater than 5 mgKOH/g, greater than 6 mgKOH/g, greater than 7 mgKOH/g, greater than 9 mgKOH/g, or greater than 9 mgKOH/g.

The engine oil compositions have outstanding performance in the ball rust test (BRT) of ASTM D6557. Preferably, the average gray value is at least 100, or at least 110, or at least 120.

The engine oil compositions preferably have a sulfated ash content as determined by ASTM D874, of greater than 0.2 wt %, greater than 0.4 wt %, or greater than 0.6 wt %.

The engine oil compositions preferably have a combined concentration of Ca and Mg in the engine oil composition, when one or both are present, is at least 0.05 wt % of the composition, more preferably at least 0.08 wt % of the composition, most preferably at least 0.10 wt % of the composition.

Preferably the phosphorus content of the engine oil composition is due primarily to the presence of ZDDP.

In a preferred embodiment, the lubricating compositions are formulated to be automotive engine oils. Viscosity grades for automotive engine oils are defined by the Society of Automotive Engineers (SAE) specification SAE J300 (January 2009) as follows in Table 3B:

TABLE B

Automotive Lubricant Viscosity Grades[1]
Engine Oils - SAE J 300, January 2009

| | Low Temperature Viscosities | | High-Temperature Viscosities | | |
|---|---|---|---|---|---|
| | | | | | High Shear[5] |
| SAE Viscosity Grade | Cranking[2] (mPa · s) max at temp ° C. | Pumping[3] (mPa · s) max at temp ° C. | Kinematic[4] ($mm^2/s$) at 100° C. min | Kinematic[4] ($mm^2/s$) at 100° C. max | Rate (mPa · s) at 150° C., 10/s min |
| 0W | 6200 at −35 | 60 000 at −40 | 3.8 | — | — |
| 5W | 6600 at −30 | 60 000 at −35 | 3.8 | — | — |
| 10W | 7000 at −25 | 60 000 at −30 | 4.1 | — | — |
| 15W | 7000 at −20 | 60 000 at −25 | 5.6 | — | — |
| 20W | 9500 at −15 | 60 000 at −20 | 5.6 | — | — |
| 25W | 13 000 at −10 | 60 000 at −15 | 9.3 | — | — |
| 20 | — | — | 5.6 | <9.3 | 2.6 |
| 30 | — | — | 9.3 | <12.5 | 2.9 |
| 40 | — | — | 12.5 | <16.3 | 3.5[6] |
| 40 | — | — | 12.5 | <16.3 | 3.7[7] |
| 50 | — | — | 16.3 | <21.9 | 3.7 |
| 60 | — | — | 21.9 | <26.1 | 3.7 |

[1]All values are critical specifications as defined by ASTM D3244
[2]ASTM D5293
[3]ASTM D4684. Note that the presence of any yield stress detectable by this method constitutes a failure regardless of viscosity.
[4]ASTM D445
[5]ASTM D4683, CEC L-36-A-90 (ASTM D4741) or ASTM DS481
[6]0W-40, 5W-40 & 10W-40 grades
[7]15W-40, 20W-40, 25W-40 grades Preferably, the engine oil compositions are formulated to be a "0W" SAE monograded viscosity.

The kinematic viscosities at 100° C. of the engine oil compositions were measured according to the ASTM D445 standard. Preferably, the engine oil compositions have a kinematic viscosity at 100° C. of from 4 cSt to 6 cSt, from 4 cSt to 5.5 cSt, or from 4 cSt to 5 cSt.

The kinematic viscosities at 40° C. of the engine oil compositions were measured according to the ASTM D445 standard. Preferably, the engine oil compositions have a kinematic viscosity at 40° C. of from 15 cSt to 35 cSt, from 15 cSt to 30 cSt, from 15 cSt to 25 cSt, or from 18 cSt to 22 cSt.

The present invention, accordingly, provides the following embodiments:

A. An engine oil composition, comprising in admixture:

60 wt % to 90 wt % of a first base oil component, based on the total weight of the composition, the first base oil component consisting of a polyalphaolefin base stock or combination of polyalphaolefin base stocks, each having a kinematic viscosity at 100° C. of from 3.2 cSt to 3.8 cSt; and 0.1 wt % to 20 wt % of a second base oil component, based on the total weight of the composition, the second base oil component consisting of a Group II, Group III or Group V base stock, or any combination thereof;

wherein the composition comprises from 0 wt % to less than 0.25 wt % viscosity index improver, on a solid polymer basis;

wherein the composition has a kinematic viscosity at 100° C. of from 4 to 6 cSt, a Noack volatility of less than 15% as determined by ASTM D5800, a CCS viscosity of less than 3500 cP at −35° C. as determined by ASTM D5293, and an HTHS viscosity of less than 2.6 mPa-s at 150° C. as determined by ASTM D4683.

B. The engine oil composition of embodiment A, wherein the first base oil component consists of a polyalphaolefin base stock chosen from the group consisting of a metallocene-catalyzed polyalphaolefin base stock and a polyalphaolefin base stock obtained by a process for producing low viscosity polyalphaolefins having a carbon count of C28 to C32, said process comprising a first step that provides a tri-substituted vinylene intermediate polyalphaolefin dimer with metallocene catalysis, and a second step that provides a C28 to C32 polyalphaolefin trimer through addition of a monomer to the tri-substituted vinylene dimer, or any combination thereof.

C. The engine oil composition of any one or any combination of embodiments A to B, wherein the first base oil component consists of a polyalphaolefin chosen from the group consisting of a metallocene-catalyzed polyalphaolefin base stock and a polyalphaolefin base stock obtained by a process comprising:

a. contacting a catalyst, an activator, and a monomer in a first reactor to obtain a first reactor effluent, the effluent comprising a dimer product, a trimer product, and optionally a higher oligomer product,
b. feeding at least a portion of the dimer product to a second reactor,
c. contacting said dimer product with a second catalyst, a second activator, and optionally a second monomer in the second reactor,
d. obtaining a second reactor effluent, the effluent comprising at least a trimer product, and
e. hydrogenating at least the trimer product of the second reactor effluent, wherein the dimer product of the first reactor effluent contains at least 25 wt % of tri-substituted vinylene represented by the following structure:

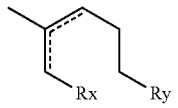

and the dashed line represents the two possible locations where the unsaturated double bond may be located and Rx and Ry are independently selected from a $C_3$ to $C_{21}$ alkyl group, or any combination thereof.

D. The engine oil composition of embodiment C, wherein the first reactor effluent contains less than 70 wt % of di-substituted vinylidene represented by the following formula:

$$RqRzC{=}CH_2$$

wherein Rq and Rz are independently selected from alkyl groups.

E. The engine oil composition of any one or any combination of embodiments C to D, wherein the dimer product of the first reactor effluent contains greater than 50 wt % of tri-substituted vinylene dimer.

F. The engine oil composition of any one or any combination of embodiments C to E, wherein the second reactor effluent has a product having a carbon count of C28-C32, wherein said product comprises at least 70 wt % of said second reactor effluent.

G. The engine oil composition of any one or any combination of embodiments C to F, wherein the monomer contacted in the first reactor is comprised of at least one linear alpha olefin wherein the linear alpha olefin is selected from at least one of 1-hexene, 1-octene, 1-nonene, 1-decene, 1-dodecene, 1-tetradecene, and combinations thereof.

H. The engine oil composition of any one or any combination of embodiments C to G, wherein monomer is fed into the second reactor, and the monomer is a linear alpha olefin selected from the group including 1-hexene, 1-octene, 1-nonene, 1-decene, 1-dodecene, and 1-tetradecene.

I. The engine oil composition of any one or any combination of embodiments C to H, wherein said catalyst in said first reactor is represented by the following formula:

$$X_1X_2M_1(CpCp^*)M_2X_3X_4$$

wherein:

$M_1$ is an optional bridging element;

$M_2$ is a Group 4 metal;

Cp and Cp* are the same or different substituted or unsubstituted cyclopentadienyl ligand systems, or are the same or different substituted or unsubstituted indenyl or tetrahydroindenyl rings wherein, if substituted, the substitutions may be independent or linked to form multicyclic structures;

$X_1$ and $X_2$ are independently hydrogen, hydride radicals, hydrocarbyl radicals, substituted hydrocarbyl radicals, silylcarbyl radicals, substituted silylcarbyl radicals, germylcarbyl radicals, or substituted germylcarbyl radicals; and $X_3$ and $X_1$ are independently hydrogen, halogen, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both $X_3$ and $X_4$ are joined and bound to the metal atom to form a metallacycle ring containing from about 3 to about 20 carbon atoms.

J. The engine oil composition of any one or any combination of embodiments C to I, wherein the first step of contacting occurs by contacting the catalyst, activator system, and monomer wherein the catalyst is represented by the formula of $$X_1X_2M_1(CpCp^*)M_2X_3X_4$$

wherein:

M1 is a bridging element of silicon,

M2 is the metal center of the catalyst, and is preferably titanium, zirconium, or hafnium, Cp and Cp* are the same or different substituted or unsubstituted indenyl or tetrahydroindenyl rings that are each bonded to both $M_1$ and $M_2$, and X1, X2, X3, and X4 or are preferably independently selected from hydrogen, branched or unbranched $C_1$ to $C_{20}$ hydrocarbyl radicals, or branched or unbranched substituted $C_1$ to $C_{20}$ hydrocarbyl radicals; and the activator system is a combination of an activator and co-activator, wherein the activator is a non-coordinating anion, and the co-activator is a tri-alkylaluminum compound wherein the alkyl groups are independently selected from C1 to C20 alkyl groups, wherein the molar ratio of activator to transition metal compound is in the range of 0.1 to 10 and the molar ratio of co-activator to transition metal compound is 1 to 1000, and the catalyst, activator, co-activator, and monomer are contacted in the absence of hydrogen, at a temperature of 80° C. to 150° C., and with a reactor residence time of 2 minutes to 6 hours.

K. The engine oil composition of any one or any combination of embodiments A to J, wherein the second base oil component comprises a Group V base stock.

L. The engine oil composition of any one or any combination of embodiments A to K, wherein the second base oil component comprises an alkylated naphthalene base stock.

M. The engine oil composition of any one or any combination of embodiments A to L, wherein the engine oil composition is a 0W SAE monograde viscosity.

N. The engine oil composition of any one or any combination of embodiments A to M, wherein the engine oil composition has a kinematic viscosity at 10° C. of 5 cSt or less.

O. The engine oil composition of any one or any combination of embodiments A to N, wherein the engine oil composition has a CCS viscosity of less than 2500 cP at −35° C. as determined by ASTM D15293.

P. The engine oil composition of any one or any combination of embodiments A to O, wherein the engine oil composition has a TEOST MHT-4 deposit of less than 35 mg as determined by ASTM D7097.

Q. The engine oil composition of any one or any combination of embodiments A to P, wherein the engine oil composition has a total base number of at least 6.0 mgKOH/g as determined by ASTM D2896.

R. The engine oil composition of any one or any combination of embodiments A to Q, wherein the engine oil composition has an average gray value of at least 100 as determined by ASTM D6557.

S. The engine oil composition of any one or any combination of embodiments A to R, wherein the engine oil composition has a sulfated ash content of greater than 0.2 wt % as determined by ASTM D874.

T. The engine oil composition of any one or any combination of embodiments A to S, wherein the engine oil composition has a combined calcium and magnesium concentration, when one or both are present, of at least 0.05 wt % of the composition.

U. The engine oil composition of any one or any combination of embodiments A to T, wherein the phosphorus content of the engine oil composition is due primarily to the presence of ZDDP.

V. The engine oil composition of any one or any combination of embodiments A to U, wherein the polyalphaolefin base stock comprises decene trimer molecules.

The invention will now be more particularly described with reference to the following non-limiting Examples.

EXAMPLES

Preparation of Low Viscosity PAO Base Stocks

The various test methods and parameters used to describe the intermediate PAO and the final PAO are summarized in Table 2 below and some test methods are described in the below text.

Nuclear magnetic resonance spectroscopy (NMR), augmented by the identification and integration of end group resonances and removal of their contributions to the peak areas, were used to identify the structures of the synthesized oligomers and quantify the composition of each structure.

Proton NMR (also frequently referred to as HNMR) spectroscopic analysis can differentiate and quantify the types of olefinic unsaturation: vinylidene, 1,2-disubstituted, trisubstituted, or vinyl. Carbon-13 NMR (referred to simply as C-NMR) spectroscopy can confirm the olefin distribution calculated from the proton spectrum. Both methods of NMR analysis are well known in the art.

For any HNMR analysis of the samples a Varian pulsed Fourier transform NMR spectrometer equipped with a variable temperature proton detection probe operating at room temperature was utilized. Prior to collecting spectral data for a sample, the sample was prepared by diluting it in deuterated chloroform ($CDCl_3$) (less than 10% sample in chloroform) and then transferring the solution into a 5 mm glass NMR tube. Typical acquisition parameters were SW>10 ppm, pulse width<30 degrees, acquisition time=2 s, acquisition delay=5 s and number of co-added spectra=120. Chemical shifts were determined relative to the $CDCl_3$ signal set to 7.25 ppm.

Quantitative analysis of the olefinic distribution for structures in a pure dimer sample that contain unsaturated hydrogen atoms was performed by HNMR and is described below. Since the technique detects hydrogen, any unsaturated species (tetrasubstituted olefins) that do not contain olefinic hydrogens are not included in the analysis (C-NMR must be used for determining tetrasubstituted olefins). Analysis of the olefinic region was performed by measuring the normalized integrated intensities in the spectral regions shown in Table 1. The relative number of olefinic structures in the sample were then calculated by dividing the respective region intensities by the number of olefinic hydrogen species in the unsaturated structures represented in that region. Finally, percentages of the different olefin types were determine by dividing the relative amount of each olefin type by the sum of these olefins in the sample.

TABLE 1

| Region Chemical Shift (ppm) | Olefininc Species type | Number of Hydrogens in Olefinic Species |
|---|---|---|
| 4.54 to 4.70 | Vinylidene | 2 |
| 4.74 to 4.80 and 5.01 to 5.19 | Trisubstituted | 1 |
| 5.19 to 5.60 | Disubstituted Vinylene | 2 |

C-NMR was used to identify and quantify olefinic structures in the fluids. Classification of unsaturated carbon types that is based upon the number of attached hydrogen atoms was determined by comparing spectra collected using the APT (Patt, S. L.; Shoolery, N., J. Mag. Reson., 46:535 (1982)) and DEPT (Doddrell, D. M.; Pegg, D. T.; Bendall, M. R., J. Mag. Reson., 48:323 (1982)) pulse sequences. APT data detects all carbons in the sample and DEPT data contains signals from only carbons that have attached hydrogens. Carbons having odd number of hydrogen atoms directly attached are represented with signals with having an opposite polarity from those having two (DEPT data) or in the case of the APT spectra zero or two attached hydrogens. Therefore, the presence of a carbon signal in an APT spectra that is absent in the DEPT data and which has the same signal polarity as a carbon with two attached hydrogen atoms is indicative of a carbon without any attached hydrogens. Carbon signals exhibiting this polarity relationship that are in the chemical shift range between 105 and 155 ppm in the spectrum are classified as carbons in olefinic structures.

With olefinic carbons previously being classified according to the number of hydrogens that are attached signal intensity can be used to identify the two carbons that are bonded together in an unsaturated structure. The intensities used were evaluated from a C-NMR spectrum that was collected using quantitative conditions. Because each olefinic bond is composed of a pair of carbons the signal intensity from each will be similar. Thus, by matching intensities to the carbon types identified above different kinds of olefinic structures present in the sample were determined. As already discussed previously, vinyl olefins are defined as containing one unsaturated carbon that is bonded to two hydrogens bonded to a carbon that contains one hydrogen, vinylidene olefins are identified as having a carbon with two hydrogens bonded to a carbon without any attached hydrogens, and trisubstituted olefins are identified by having both carbons in the unsaturated structure contain one hydrogen atom. Tetrasubstituted olefin carbons are unsaturated structures in which neither of the carbons in the unsaturated structure have any directly bonded hydrogens.

A quantitative C-NM R spectrum was collected using the following conditions: 50 to 75 wt % solutions of the sample in deuterated chloroform containing 0.1 M of the relaxation agent $Cr(acac)_3$ (tris(acetylacetonato)-chromium (III)) was placed into a NMR spectrometer. Data was collected using a 30 degree pulse with inverse gated H decoupling to suppress any nuclear Overhauser effect and an observe sweep width of 200 ppm.

Quantitation of the olefinic content in the sample is calculated by ratioing the normalized average intensity of the carbons in an olefinic bond multiplied by 1000 to the total carbon intensity attributable to the fluid sample. Percentages of each olefinic structure can be calculated by summing all of the olefinic structures identified and dividing that total into the individual structure amounts.

Gas chromatography (GC) was used to determine the composition of the synthesized oligomers by molecular weight. The gas chromatograph is a HP model equipped with a 15 meter dimethyl siloxane. A 1 microliter sample was injected into the column at 40° C., held for 2 minutes, program-heated at 11° C. per minute to 350° C. and held for 5 minutes. The sample was then heated at a rate of 20° C. per minute to 390° C. and held for 17.8 minutes. The content of the dimer, trimer, tetramer of total carbon numbers less than 50 can be analyzed quantitatively using the GC method. The distribution of the composition from dimer, trimer and tetramer and/or pentamer can be fit to a Bernoullian distribution and the randomness can be calculated from the difference between the GC analysis and best fit calculation.

TABLE 2

| Parameter | Units | Test |
|---|---|---|
| Viscosity Index (VI) | — | ASTM Method D2270 |
| Kinematic Viscosity (KV) | cSt | ASTM Method D445, measured at either 100° C. or 40° C. |
| Noack Volatility | % | ASTM D5800 |
| Pour Point | ° C. | ASTM D97 |
| Molecular Weights, Mn, Mw | | GC, See above text |
| Cold Crank Simulator (CCS) | | ASTM D5293 |
| Oligomer structure identification | | Proton NMR, See above text |
| Oligomer structure quantification | % | $C^{13}$ NMR, See above text |

Example 1

A 97% pure 1-decene was fed to a stainless steel Parr reactor where it was sparged with nitrogen for 1 hour to obtain a purified feed. The purified stream of 1-decene was then fed at a rate of 2080 grams per hour to a stainless steel Parr reactor for oligomerization. The oligomerization temperature was 120° C. The catalyst was dimethylsilyl-bis(tetrahydroindenyl)zirconium dimethyl (hereinafter referred to as "Catalyst 1"). A catalyst solution including purified toluene, tri n-octyl aluminum (TNOA), and N,N-dimethylanilinium tetrakis (penta-fluorophenyl)borate (hereinafter referred to as "Activator 1") was prepared per the following recipe based on 1 gram of Catalyst 1:

| | |
|---|---|
| Catalyst 1 | 1 gram |
| Purified Toluene | 376 grams |
| 25% TNOA in Toluene | 24 grams |
| Activator 1 | 1.9 grams |

The 1-decene and catalyst solution were fed into the reactor at a ratio of 31,200 grams of LAO per gram of catalyst solution. Additional TNOA was also used as a scavenger to remove any polar impurities and added to the reactor at a rate of 0.8 grams of 0.25% TNOA in toluene per 100 grams of purified LAO. The residence time in the reactor was 2.7 hours. The reactor was run at liquid full conditions, with no addition of any gas. When the system reached steady-state, a sample was taken from the reactor effluent and the dimer portion was separated by distillation. The mass percentage of each type of olefin in the distilled intermediate PAO dimer, as determined by proton NMR, is shown in Table 3. This example provides a characterization of the olefinic composition of the intermediate PAO dimer formed in the first step of the process of the invention.

TABLE 3

| Olefin Type | Percent by Mass of Olefin in Dimer Mixture |
|---|---|
| Vinylidene | 29% |
| Tri-substituted Vinylene | 60% |
| di-substituted vinylene | 11% |

Example 2

The reactor effluent from Example 1 was distilled to remove the unreacted LAO and to separate the olefin fractions. The different olefin fractions were each to hydrogenated in a stainless steel Parr reactor at 232° C. and 2413 kPa (350 psi) of hydrogen for 2 hours using 0.5 wt % Nickel Oxide catalyst. Properties of each hydrogenated distillation cut are shown in Table 4. This example demonstrates that, with the exception of the intermediate PAO dimer, the intermediate PAO cuts have excellent properties.

TABLE 4

| Component | Oligomer Yield (%)* | KV at 100° C. (cSt) | KV at 40° C. (cSt) | VI | Pour Point (° C.) | Noack Volatility (%) |
|---|---|---|---|---|---|---|
| Intermediate PAO Dimer (C20) | 33 | 1.79 | 4.98 | N/A | −12 | N/A |
| Intermediate PAO Trimer (C30) | 31 | 3.39 | 13.5 | 128 | −75 | 12.53 |
| Intermediate PAO Tetramer+ (C40+) | 31 | 9.34 | 53.57 | 158 | −66 | 3.15 |

*Yields reported are equivalent to mass % of reactor effluent; 6% of reactor effluent was monomer.

Example 3 mPAO dimer portion from a reaction using the procedure of Example 1 (and therefor having the properties/components listed above), and prior to any hydrogenation of the dimer, was oligomerized with 1-decene in a stainless steel Parr reactor using a $BF_3$ catalyst promoted with a $BF_3$ complex of butanol and butyl acetate. The intermediate PAO dimer was fed at a mass ratio of 2:1 to the 1-decene. The reactor temperature was 32° C. with a 34.47 kPa (5 psi) partial pressure of $BF_3$ and catalyst concentration was 30 mmol of catalyst per 100 grams of feed. The catalyst and feeds were stopped after one hour and the reactor contents were allowed to react for one hour. A sample was then collected and analyzed by GC. Table 5 compares conversion of the intermediate PAO dimer and conversion of the 1-decene. Table 6 gives properties and yield of the PAO co-dimer resulting from the reaction of the LAO and intermediate PAO dimer.

The data in Tables 5 and 6 demonstrate that the intermediate PAO dimer from Example 1 is highly reactive in an acid catalyzed oligomerization and that it produces a co-dimer with excellent properties. Because the 1-decene dimer has the same carbon number as the intermediate mPAO dimer, it is difficult to determine exactly how much intermediate mPAO dimer was converted. Table 4 specifies the least amount of intermediate PAO dimer converted (the assumption being that all dimer in the reactor effluent was unreacted intermediate PAO) and also the estimated amount converted, calculated by assuming that only the linear portion of the dimer GC peak is unreacted intermediate PAO dirmer and the other portion is formed by the dimerization of the 1-decene.

Example 4

The procedure of Example 3 was followed, except that the unhydrogenated intermediate PAO dimer portion was reacted with 1-octene instead of 1-decene. Results are shown in Tables 5 and 6 below. Because the 1-octene dimer has a different carbon number than the intermediate PAO dimer, conversion of the intermediate PAO dimer is measured and need not be estimated.

Example 5

The procedure of Example 3 was followed, except that the unhydrogenated intermediate PAO dimer portion was reacted with 1-dodecene instead of 1-decene. Results are shown in Tables 5 and 6 below.

TABLE 5

| Example | LAO Feed | Conversion of Intermediate mPAO Dimer | Conversion of LAO | Conversion Intermediate mPAO Dimer/ Conversion LAO |
|---|---|---|---|---|
| 3 | 1-decene | >80% (95% estimated) | 97% | >.82(.98 estimated) |
| 4 | 1-octene | 89% | 91% | .98 |
| 5 | 1-dodecene | 91% | 79% | 1.15 |

Example 6

A trimer was olgomerized from 1-decene in a stainless steel Parr reactor using a $BF_3$ catalyst promoted with a $BF_3$ complex of butanol and butyl acetate. The reactor temperature was 32° C. with a 34.47 kPa (5 psi) partial pressure of $BF_3$ and catalyst concentration was 30 mmol of catalyst per 100 grams of feed. The catalyst and feeds were stopped after one hour and the reactor contents were allowed to react for one hour. These are the same conditions that were used in the reactions of Examples 3 to 5, except that 1-decene was fed to the reactor without any intermediate PAO dimer. A sample of the reaction effluent was then collected and analyzed by GC. Table 6 shows properties and yield of the resulting PAO trimer. This example is useful to show a comparison between an acid based oligomerization process with a pure LAO feed (Example 6) versus the same process with a mixed feed of the inventive intermediate mPAO dimer from Example 1 and LAO (Examples 3-5). The addition of the intermediate mPAO dimer contributes to a higher trimer yield and this trimer has improved VI and Noack Volatility.

TABLE 6

| Example | Co-dimer Yield (%) | KV at 100° C. (cSt) | KV at 40° C. (cSt) | VI | Pour Point (° C.) | Noack Volatility (%) |
|---|---|---|---|---|---|---|
| 3 | 77 | 3.52 | 13.7 | 129 | −75 | 9.97 |
| 4 | 71 | 3.20 | 12.5 | 124 | −81 | 18.1 |
| 5 | 71 | 4.00 | 16.9 | 139 | −66 | 7.23 |
| 6 | 62 | 3.60 | 15.3 | 119 | −75 | 17.15 |

Example 7

The intermediate mPAO dimer portion from a reaction using the procedure and catalysts system of Example 1 was oligomerized with 1-octene and 1-dodecene using an $AlCl_3$ catalyst in a five liter glass reactor. The intermediate mPAO dimer portion comprised 5% by mass of the combined LAO and dimer feed stream. The reactor temperature was 36° C., pressure was atmospheric, and catalyst concentration was 2.92% of the entire feed. The catalyst and feeds were stopped after three hours and the reactor contents were allowed to react for one hour. A sample was then collected and analyzed. Table 7 shows the amount of dimer in the reactor effluent as measured by GC (i.e. new dimer formed, and residual intermediate dimer) and the effluent's molecular weight distribution as determined by GPC.

Example 8

1-octene and 1-dodecene were fed to a reactor without any intermediate mPAO dimer following the same conditions and catalysts used in Example 7. Table 7 shows the amount of dimer in the reactor effluent and the effluent's molecular weight distribution. Comparing Examples 7 and 8 shows the addition of the intermediate mPAO dimer with high tri-substituted vinylene content to an acid catalyst process yielded a product with a similar weight distribution but with less dimer present; the lower dimer amounts being a commercially preferable result due to limited use of the dimer as a lubricant basestock.

TABLE 7

| Example | Dimer (mass %) | Mw/Mn | Mz/Mn |
|---|---|---|---|
| 7 | 0.79 | 1.36 | 1.77 |
| 8 | 1.08 | 1.36 | 1.76 |

Example 9

A 97% pure 1-decene was fed to a stainless steel Parr reactor where it was sparged with nitrogen for 1 hour to obtain a purified feed. The purified stream of 1-decene was then fed at a rate of 2080 grams per hour to a stainless steel Parr reactor for oligomerization. The oligomerization temperature was 120° C. The catalyst was Catalyst 1 prepared in a catalyst solution including purified toluene, tri n-octyl aluminum (TNOA), and Activator 1. The recipe of the catalyst solution, based on 1 gram of Catalyst 1, is provided below:

| | |
|---|---|
| Catalyst 1 | 1 gram |
| Purified Toluene | 376 grams |
| 25% TNOA in Toluene | 24 grams |
| Activator 1 | 1.9 grams |

The 1-decene and catalyst solution were fed into the reactor at a ratio of 31,200 grains of LAO per gram of catalyst solution. Additional TNOA was also used as a scavenger to remove any polar impurities and added to the LAO at a rate of 0.8 grams of 0.25% TNOA in toluene per 100 grams of purified LAO. The residence time in the reactor was 2.8 hours.

The reactor was run at liquid full conditions, with no addition of any gas. When the system reached steady-state, a sample was taken from the reactor effluent and the composition of the crude polymer was determined by GC. The percent conversion of LAO, shown in Table 8, was computed from the GC results. Kinematic viscosity of the intermediate PAO product (after monomer removal) was measured at 100° C.

Example 10

The procedure of Example 9 was followed with the exception that the reactor temperature was 110° C.

Example 11

The procedure of Example 9 was followed with the exception that the reactor temperature was 130° C.

Example 12

The procedure of Example 9 was followed with the exception that the residence time in the reactor was 2 hours and the catalyst amount was increased to 23,000 grams of LAO per gram of catalyst to attain a similar conversion as the above Examples.

Example 13

The procedure of Example 9 was followed with the exception that the residence time in the reactor was 4 hours and the catalyst amount was decreased to 46,000 grams of LAO per gram of catalyst to attain a similar conversion as the above Examples.

Example 14

The procedure of Example 9 was followed with the exception that the reactor was run in semi-batch mode (the feed streams were continuously added until the desired amount was achieved and then the reaction was allowed to continue without addition new feedstream) and the catalyst used was bis(1-butyl-3-methyl cyclopentadienyl)zirconium dichloride (hereinafter referred to as "Catalyst 2") that had been alkylated with an octyl group by TNOA. In this Example, conversion of LAO was only 449%. The kinematic viscosity at 100° C. is not reported due to low conversion.

TABLE 8

| Example | Catalyst System/ Catalyst Concentration (g LAO/g Cat) | Reaction Temp (° C.) | Residence Time in Reactor (hrs) | Conversion of LAO (% mass) | Effluent Kinematic Viscosity at 100° C. (cSt) | Intermediate PAO Kinematic Viscosity at 100° C. (cSt) |
|---|---|---|---|---|---|---|
| 9 | Catalyst 1/ 31,200 | 120 | 2.8 | 94 | 2.45 | 2.73 |
| 10 | Catalyst 1/ 31,200 | 110 | 2.8 | 93 | 3.26 | 3.55 |
| 11 | Catalyst 1/ 31,200 | 130 | 2.8 | 91 | 2.11 | 2.36 |
| 12 | Catalyst 1/ 23,000 | 120 | 2 | 94 | 2.42 | 2.77 |
| 13 | Catalyst 1/ 46,000 | 120 | 4 | 93 | 2.50 | 2.84 |
| 14 | Catalyst 2 (octylated)/ 31,200 | 120 | 2.8 | 44 | — | — |

Example 15

A dimer was formed using a process similar to what is described in U.S. Pat. No. 4,973,788. The LAO feedstock was 1-decene and TNOA was used as a catalyst. The contents were reacted for 86 hours at 120° C. and 172.37 kPa (25 psi) in a stainless steel Parr reactor. Following this, the dimer product portion was separated from the reactor effluent via distillation and its composition was analyzed via proton-NMR and is provided in Table 9.

TABLE 9

| | |
|---|---|
| Vinylidene | 96% |
| Di-substituted olefins | 4% |
| Tri-substituted olefins | 0% |

This $C_{20}$ dimer portion was then contacted with a 1-octene feedstock and a butanol/butyl acetate promoter system in a second stainless steel Parr reactor. The molar feed ratio of dimer to LAO was 1:1, the molar feed ratio of butanol to butyl acetate was 1:1, and the promoter was fed at a rate of 30 mmol/100 grams of LAO. The reaction temperature was 32° C. with a 34.47 kPa (5 psi) partial pressure of $BF_3$ providing the acid catalyst, the feed time was one hour, and then the contents were allowed to react for another hour. A sample was then taken from the product stream and analyzed via GC. The composition is provided below in Table 10. Applicants believe the dimer composition and other feedstocks used in this Example 15 are similar to the dimer composition and feedstocks used in multiple examples in U.S. Pat. No. 6,548,724.

Example 16

This example was based on an intermediate mPAO dimer resulting from a reaction using the procedure and catalyst system of Example 1; the resulting intermediate mPAO dimer had the same composition as set forth in Table 3. The intermediate mPAO dimer portion was reacted in a second reactor under feedstock and process conditions identical to the second oligomerization of Example 15. A sample of the PAO produced from the second oligomerization was taken from the product stream and analyzed via GC for its composition and the analysis is provided below in Table 10 (it is noted that this Example is a repeat of Example 4; the analyzed data is substantially similar for this second run of the same reactions and resulting PAO obtained from oligomerizing a primarily tri-substituted olefin).

TABLE 10

| Second reactor effluent | Example 15 | Example 16 |
|---|---|---|
| Unreacted monomer | 0.3% | 0.7% |
| Lighter fractions | 22.0% | 13.2% |
| $C_{28}$ fraction | 59.0% | 72.5% |
| Heavier fractions | 18.7% | 13.6% |

The yield of the $C_{28}$ fraction was increased from 59.0% to 72.5% by utilizing an intermediate dimer comprising primarily tri-substituted olefins instead of an intermediate dimer comprising primarily vinylidene olefins. Thus, use of an intermediate PAO dimer comprising primarily tri-substituted olefins is highly preferred over a dimer comprising primarily vinylidene due to the significant increases in yield of the ($C_{28}$ co-dimer product that is commercially valuable for low viscosity applications.

Example 17

Example 17 was prepared in a manner identical to Example 15, except that the LAO feedstock in the second reactor for the acid based oligomerization was 1-decene instead of 1-octene. Applicants believe the dimer composition and other feedstocks used in Example 17 are also similar to the dimer composition and feedstocks used in multiple examples in U.S. Pat. No. 6,548,724. A sample was taken from the product stream of the second reactor and analyzed via GC, and the composition is provided below in Table 11.

Example 18

Example 18 was performed identical to Example 16, except that the LAO feedstock in the second reactor was 1-decene instead of 1-octene. A sample was taken from the product stream of the second reactor and analyzed. The overall composition of the reactor PAO product is provided below in Table 11. The $C_{30}$ fraction, prior to hydrogenation, has approximately 21% tetra-substituted olefins, as determined by carbon-NMR; the remaining structure is a mixture of vinylidene and tri-substituted olefins.

TABLE 11

| Second Reactor Effluent | Example 17 | Example 18 |
|---|---|---|
| Unreacted Monomer | 0.7% | 0.7% |
| Lighter Fractions | 7.3% | 9.0% |
| $C_{30}$ Fraction | 71.4% | 76.1% |
| Heavier Fractions | 20.6% | 14.2% |

Examples 17 and 18 show that, again, using a dimer intermediate comprising primarily tri-substituted olefins increases the yield of the desired $C_{30}$ product. Since the carbon number of the co-dimer and the $C_{10}$ trimer is the same in these experiments, it is infeasible to separately quantify the amount of co-dimer and $C_{10}$ trimer. Instead, the $C_{30}$ material was separated via distillation and the product properties were measured for both Examples 17 and 18.

For comparison purposes, a $C_{10}$ trimer was obtained from a $BF_3$ oligomerization wherein the above procedures for the second reactor of Examples 17 and 18 were used to obtain the trimer; i.e. there was no first reaction with either TNOA or Catalyst 1 and thus, no dimer feed element in the acid catalyst oligomerization. Properties of this $C_{10}$ trimer were measured and are summarized in Table 12 and compared to the $C_{30}$ trimers of Examples 17 and 18.

TABLE 12

| Example | KV at 100° C. (cSt) | KV at 40° C. (cSt) | VI | Pour Point (° C.) | Noack Volatility (%) |
|---|---|---|---|---|---|
| Example 17 $C_{30}$ | 3.47 | 14.1 | 127 | −69 | 13.9 |
| Example 18 $C_{30}$ | 3.50 | 14.1 | 130 | −78 | 12.0 |
| $BF_3$ $C_{10}$ trimer | 3.60 | 15.3 | 119 | −75 | 17.2 |

Table 12 evidences a clear difference between a $C_{30}$ material formed using a tri-substituted vinylene dimer feed element in a $BF_3$ oligomerization (Example 18) versus a $C_{30}$ material formed in a $BF_3$ oligomerization using a vinylidene dimer feed element (Example 17). The $C_{30}$ material obtained using tri-substituted vinylene dimers has a similar viscosity with a significantly improved VI and a lower Noack Volatility than the $C_{30}$ material obtained using vinylidene dimers under equivalent process conditions. Furthermore, the $C_{30}$ material obtained using vinylidene dimers has properties more similar to those of a $C_{10}$ trimer in a $BF_3$ process than the $C_{30}$ material obtained using tri-substituted vinylene dimers, indicating that a greater portion of the $C_{30}$ yield is a $C_{10}$ trimer and not a co-dimer of the vinylidene dimer and 1-decene.

Example 19

Example 19 was prepared using the catalyst system and process steps of Example 1 except that the starting LAO feed was 97% pure 1-octene and the oligomerization temperature was 130° C. When the system reached steady-state, a sample was taken from the reactor effluent and fractionated to obtain $C_{16}$ olefin portion (1-octene dimer) that was approximately 98% pure. This intermediate PAO dimer was analyzed by proton NMR and had greater than 50% tri-substituted olefin content.

This intermediate mPAO) dimer portion was then oligomerized with 1-dodecene, using a $BF_3$ catalyst, and a butanol/butyl acetate promoter system in a second reactor. The intermediate mPAO dimer was fed at a 1:1 mole ratio to the 1-dodecene and catalyst concentration was 30 mmol of catalyst per 100 grams of feed. The reactor temperature was 32° C. The catalyst and feeds were stopped after one hour and the reactor contents were allowed to react for one additional hour. A sample was then collected, analyzed by GC (see Table 14), and fractionated to obtain a cut of $C_2$ that was about 97% pure. The $C_{28}$ olefin portion was hydrogenated and analyzed for its properties; results are shown in Table 13.

Example 20

Similar to Example 19, except that the intermediate mPAO $C_{16}$ dimer portion produced was oligomerized with 1-tetradecene, instead of 1-dodecene. A sample was collected from the second reactor and analyzed by GC for fraction content (see Table 14). The $C_{30}$ olefin portion of the effluent was obtained via conventional distillation means and the trimer was hydrogenated and analyzed for its properties; results are shown in Table 13.

Example 21

Similar to Example 19, except that the intermediate mPAO $C_{16}$ dimer portion produced was oligomerized with 1-hexadecene, instead of 1-dodecene, in the subsequent step to produce a $C_{32}$ trimer. A sample was collected from the second reactor and analyzed by GC for fraction content (see Table 14). The $C_{32}$ olefin portion of the effluent was obtained via conventional distillation means and the trimer was hydrogenated and analyzed for its properties; results are shown in Table 13.

Example 22

Example 22 was prepared using the catalyst system and process steps of Example 1 except that the LAO feed was 97% pure 1-dodecene and the oligomerization temperature was 130° C. When the system reached steady-state, a sample was taken from the reactor effluent and fractionated to obtain a $C_{24}$ olefin (1-dodecene dimer) portion that was about 98% pure. This intermediate mPAO dimer was analyzed by proton-NMR and had greater than 50% tri-substituted olefin content.

The $C_{24}$ intermediate mPAO dimer portion was then oligomerized with 1-hexene, using a $BF_3$ catalyst, and a butanol/butyl acetate promoter system in a second reactor. The $C_{24}$ intermediate PAO dimer was fed at a 1:1 mole ratio to the 1-hexene and catalyst concentration was 30 mmol of catalyst per 100 grams of feed. The reactor temperature was 32° C. The catalyst and feeds were stopped after one hour and the reactor contents were allowed to react for one additional hour. A sample was then collected, analyzed by GC (see Table 14), and fractionated to obtain cut of $C_{30}$ olefin that was about 97% pure. The $C_{30}$ olefin portion was hydrogenated and analyzed for its properties, and results are shown in Table 13.

Example 23

Similar to Example 22, except that the intermediate mPAO dimer portion produced in the first reaction was then oligomerized with 1-octene, instead of 1-hexene, in the subsequent acid based oligomerization step to produce a $C_{32}$ olefin. Results are shown in Table 13.

Example 24

Example 24 was prepared using the same process and catalyst system as Example 1 except that the first oligomerization temperature was 130° C. When the system reached steady-state, a sample was taken from the reactor effluent and fractionated to obtain a $C_{20}$ intermediate mPAO dimer portion that was about 98% pure. The distilled dimer was analyzed by proton-NMR and had greater than 50% tri-substituted olefin content.

The $C_{20}$ intermediate mPAO dimer portion was then oligomerized with 1-decene, a $BF_3$ catalyst, and a butanol/butyl acetate promoter system in a second reactor. The intermediate mPAO dimer was fed at a 1:1 mole ratio to the 1-decene and catalyst concentration was 30 mmol of catalyst per 100 grams of feed. The reactor temperature was 32° C. The catalyst and feeds were stopped after one hour and the reactor contents were allowed to react for one additional hour. A sample was then collected, analyzed by GC (see Table 14), and then fractionated to obtain cut of $C_{30}$ olefin that was about 97% pure. The $C_{30}$ olefin portion was hydrogenated and analyzed; results are shown in Table 13. Applicants note that this Example 24 is similar to Example 3, with the sole difference being the first reaction temperature. A comparison of the data in Table 6 and Table 13 shows that for the higher first reaction temperature of Example 24, the kinematic viscosity and VI are comparable, and the pour point is decreased with a minor increase in Noack volatility.

Example 25

Similar to Example 24 except that the intermediate mPAO dimer portion produced was oligomerized with 1-octene, instead of 1-decene, in the subsequent reaction step to produce a $C_{28}$ olefin. Results are shown in Table 13. This data is comparable to Example 4, with substantially similar product results, even with an increased temperature in the first reactor for Example 25.

Example 26

Similar to Example 24 except that the intermediate PAO dimer portion produced was oligomerized with 1-dodecene, instead of 1-decene, in the subsequent step to produce a $C_{32}$ olefin. Results are shown in Table 13. This data is comparable to Example 5, with substantially similar product results, even with an increased temperature in the first reactor for Example 26.

TABLE 13

| Example | Product Carbon Number | Kinematic Viscosity @ 100° C., cSt | VI | Pour Point, ° C. | Noack Volatility, wt. % |
|---|---|---|---|---|---|
| 19 | 28 | 3.18 | 121 | −81 | 18.9 |
| 20 | 30 | 3.66 | 131 | −57 | 12.1 |
| 21 | 32 | 4.22 | 138 | −33 | 8.7 |
| 22 | 30 | 3.77 | 137 | −54 | 11.0 |
| 23 | 32 | 4.05 | 139 | −57 | 7.2 |
| 24 | 30 | 3.50 | 130 | −78 | 11.5 |
| 25 | 28 | 3.18 | 124 | −81 | 18 |
| 26 | 32 | 4.01 | 139 | −66 | 7.2 |

TABLE 14

| Example | Monomer, wt. % | $C_{18}$-$C_{26}$, wt. % | Desired Product, wt. % | $>C_{32}$ wt. % |
|---|---|---|---|---|
| 19 | 6.7 | 0.4 | 85.6 | 7.3 |
| 20 | 7.0 | 0.4 | 88.1 | 4.5 |
| 21 | 0.8 | 8.8 | 84.8 | 5.6 |
| 22 | 1.2 | 24.9 | 54.0 | 19.9 |
| 23 | 3.8 | 22.6 | 65.2 | 8.4 |
| 24 | 1.0 | 13.4 | 78.0 | 7.6 |
| 25 | 3.1 | 18.0 | 66.6 | 12.3 |
| 26 | 7.9 | 11.2 | 71.5 | 9.4 |

In comparing the properties and yields for each example, additional advantages to the invention are clear. For example, comparing Examples 19-21 to their carbon number equivalents in Examples 24-26 shows that the molecules in each Example with equivalent carbon numbers have similar properties. The processes of Examples 19-21, however, result in yields of desired products about 20% greater than the processes of Examples 24-26. Additionally, comparing Examples 22 and 23 to their carbon number equivalents in Examples 24 and 26 shows that the inventive products exhibit higher VIs at similar kinematic viscosities.

Engine Oil Examples

Studies were conducted to demonstrate the properties of the inventive engine oil compositions. More specifically, ultra-low viscosity automotive engine oil formulations were prepared and tested for viscometric properties, including kinematic viscosity, viscosity index (VI), Noack volatility, CCS viscosity and HTHS viscosity. In addition, other properties of the engine oils were demonstrated, including deposit performance, total base number (TBN), ball rust test (BRT) performance and sulfated ash levels. Where applicable, the ASTM methods indicated in the data tables below were used.

In the following Examples, the low viscosity PAO basestocks with the properties shown in Table C were used. The 3.4 cSt mPAO was prepared with the metallocene-catalyzed process disclosed herein, and the 3.5 cSt PAO was prepared in accordance with the two-step process disclosed herein. In addition, the properties of conventional PAO 4 base stock are shown.

TABLE C

| | 3.4 cSt mPAO | 3.5 cSt PAO | Conventional 4 cSt PAO |
|---|---|---|---|
| Feed LAO | C10 | C10 | C10 |
| KV100° C. (ASTM D445, cSt) | 3.39 | 3.54 | 4.15 |
| KV40° C. (ASTM D445, cSt) | 13.5 | 14.4 | 18.6 |
| Pour Point (ASTM D97, ° C.) | −75 | −78 | −72 |
| Viscosity Index (VI) (ASTM D2270) | 128 | 129 | 128 |
| Noack Volatility (ASTM D5800, % lost) | 12.5 | 11.8 | 12.2 |
| CCS viscosity (ASTM D5293 at −30° C., mPa · s) | 358 | 403 | 990 |
| CCS viscosity (ASTM D5293 at −35° C., mPa · s) | 623 | 819 | 1480 |
| HTHS viscosity (ASTM D4683 at 150° C., mPa · s) | 1.2 | 1.3 | 1.4 |
| Aniline Point (ASTM D611, ° C.) | 120 | 120 | 121 |
| Simulated Distillation (M1567) | | | |
| Temp at 10% off to 90% off, ° F. | 805-825 | 799-828 | 789-909 |
| Temp at 90% off minus temp at 10% off, ° F. | 20 | 29 | 120 |

0W passenger car engine oil compositions were prepared as indicated in Table D.

TABLE D

| | Oil A | Oil B | Oil C |
|---|---|---|---|
| Components | | | |
| 3.4 cSt mPAO (wt %) | 84.78 | | |
| 3.5 cSt PAO (wt %) | | 84.78 | |
| Conventional 4 cSt PAO (wt %) | | | 84.78 |
| 5 cSt Alkylated Naphthalene (wt %) | 5.00 | 5.00 | 5.00 |
| VI Improver (wt %) | 0.0 | 0.0 | 0.0 |
| Engine Oil Additives (wt. %) (do not include VI improver) | 10.22 | 10.22 | 10.22 |
| Total | 100.00 | 100.00 | 100.00 |

TABLE D-continued

| | Oil A | Oil B | Oil C |
|---|---|---|---|
| Properties | | | |
| KV100° C. (ASTM D445, cSt) | 4.516 | 4.695 | 5.382 |
| KV40° C. (ASTM D445, cSt) | 19.69 | 20.77 | 26.23 |
| Viscosity Index (VI) (ASTM D2270) | 149 | 151 | 145 |
| Noack Volatility (ASTM D5800, % lost) | 11.1 | 10.0 | 10.9 |
| CCS viscosity (ASTM D5293 at −35° C., mPa · s) | 1400 | 1500 | 2710 |
| HTHS viscosity (ASTM D4683 at 150° C., mPa · s) | 1.70 | 1.80 | 1.88 |
| TEOST MHT-4 (ASTM D7097, total deposit, mg) | 12 | 15 | |
| Total Base Number (TBN) (ASTM D2896, mgKOH/g) | 9.1 | 9.3 | 9.1 |
| Ball Rust Test (BRT) (ASTM D6557, average gray value) | 130 | 131 | |
| Sulfated Ash (ASTM D874, wt %) | 0.65 | 0.65 | 0.72 |

Table D demonstrates ultra-low viscosity engine oil formulations (Oil A and Oil B) comprising 3.4 cSt metallocene-catalyzed PAO or the 3.5 cSt PAO of the present disclosure. Each of Oils A, B and C contain the same "Engine Oil Additives" and the same 5 cSt alkylated naphthalene, in the same amounts. By using these low viscosity PAOs, engine oils can be formulated to a low overall KV100 of 4.516 cSt (Oil A) and 4.695 (Oil B), while maintaining good Noack volatility and providing improved CCS viscosity and HTHS viscosity. These are improvements over Oil C, which contains conventional PAO 4. With conventional PAO 4, to achieve a similar Noack volatility, the engine oil has a higher overall KV100 (e.g., 5.382 cSt), which will result in lower engine efficiency than lower viscosity oils Oil A and Oil B. (Oil C also has a significantly higher CCS viscosity, which will result in lower efficiency at low engine temperatures, and a higher HTHS viscosity, which will result in lower efficiency at high temperature, high shear conditions.

Table D also demonstrates the typical properties of the inventive engine oil formulations, including TEOST MHT-4 deposit performance, TBN, ball rust test (BRT) performance and sulfated ash levels.

While the above examples have been to automotive engine oils, these examples are not intended to be limiting.

What is claimed is:

1. An engine oil composition, comprising in admixture:

60 wt % to 90 wt % of a first base oil component, based on the total weight of the composition, the first base oil component consisting of a polyalphaolefin base stock or combination of polyalphaolefin base stocks, each having a kinematic viscosity at 100° C. of from 3.2 cSt to 3.8 cSt and a Noack volatility of less than or equal to 12.5 wt. %; and 0.1 wt % to 20 wt % of a second base oil component, based on the total weight of the composition, the second base oil component consisting of a Group II, Group III or Group V base stock, or any combination thereof;

wherein the composition comprises from 0 wt % to less than 0.25 wt % viscosity index improver, on a solid polymer basis;

wherein the composition has a kinematic viscosity at 100° C. of from 4 to 6 cSt, a Noack volatility of less than 15% as determined by ASTM D5800, a CCS viscosity of less than 3500 cP at −35° C. as determined by ASTM D5293, and an HTHS viscosity of less than 2.6 mPa-s at 150° C. as determined by ASTM D4683.

2. The engine oil composition of claim 1, wherein the first base oil component consists of a polyalphaolefin base stock chosen from the group consisting of a metallocene-catalyzed polyalphaolefin base stock and a polyalphaolefin base stock obtained by a process for producing low viscosity polyalphaolefins having a carbon count of C28 to C32, said process comprising a first step that provides a tri-substituted vinylene intermediate polyalphaolefin dimer with metallocene catalysis, and a second step that provides a C28 to C32 polyalphaolefin trimer through addition of a monomer to the tri-substituted vinylene dimer, or any combination thereof.

3. The engine oil composition of claim 1, wherein the first base oil component consists of a polyalphaolefin chosen from the group consisting of a metallocene-catalyzed polyalphaolefin base stock and a polyalphaolefin base stock obtained by a process comprising:

a. contacting a catalyst, an activator, and a monomer in a first reactor to obtain a first reactor effluent, the effluent comprising a dimer product, a trimer product, and optionally a higher oligomer product, b. feeding at least a portion of the dimer product to a second reactor, c. contacting said dimer product with a second catalyst, a second activator, and optionally a second monomer in the second reactor, d. obtaining a second reactor effluent, the effluent comprising at least a trimer product, and e. hydrogenating at least the trimer product of the second reactor effluent, wherein the dimer product of the first reactor effluent contains at least 25 wt % of tri-substituted vinylene represented by the following structure:

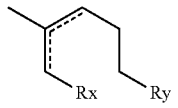

and the dashed line represents the two possible locations where the unsaturated double bond may be located and Rx and Ry are independently selected from a $C_3$ to $C_{21}$ alkyl group, or any combination thereof.

4. The engine oil composition of claim 3, wherein the first reactor effluent contains less than 70 wt % of di-substituted vinylidene represented by the following formula:

$$RqRzC{=}CH_2$$

wherein Rq and Rz are independently selected from alkyl groups.

5. The engine oil composition of claim 3, wherein the dimer product of the first reactor effluent contains greater than 50 wt % of tri-substituted vinylene dimer.

6. The engine oil composition of claim 3, wherein the second reactor effluent has a product having a carbon count of C28-C32, wherein said product comprises at least 70 wt % of said second reactor effluent.

7. The engine oil composition of claim 3, wherein the monomer contacted in the first reactor is comprised of at least one linear alpha olefin wherein the linear alpha olefin is selected from at least one of 1-hexene, 1-octene, 1-nonene, 1-decene, 1-dodecene, 1-tetradecene, and combinations thereof.

8. The engine oil composition of claim 3, wherein monomer is fed into the second reactor, and the monomer is a linear alpha olefin selected from the group including 1-hexene, 1-octene, 1-nonene, 1-decene, 1-dodecene, and 1-tetradecene.

9. The engine oil composition of claim 3, wherein said catalyst in said first reactor is represented by the following formula:

$$X_1X_2M_1(CpCp^*)M_2X_3X_4$$

wherein:

$M_1$ is an optional bridging element;

$M_2$ is a Group 4 metal;

Cp and Cp* are the same or different substituted or unsubstituted cyclopentadienyl ligand systems, or are the same or different substituted or unsubstituted indenyl or tetrahydroindenyl rings wherein, if substituted, the substitutions may be independent or linked to form multicyclic structures;

$X_1$ and $X_2$ are independently hydrogen, hydride radicals, hydrocarbyl radicals, substituted hydrocarbyl radicals, silylcarbyl radicals, substituted silylcarbyl radicals, germylcarbyl radicals, or substituted germylcarbyl radicals; and $X_3$ and $X_4$ are independently hydrogen, halogen, hydride radicals, hydrocarbyl radicals, substituted hydrocarbyl radicals, halocarbyl radicals, substituted halocarbyl radicals, silylcarbyl radicals, substituted silylcarbyl radicals, germylcarbyl radicals, or substituted germylcarbyl radicals; or both $X_3$ and $X_4$ are joined and bound to the metal atom to form a metallacycle ring containing from about 3 to about 20 carbon atoms.

10. The engine oil composition of claim 3, wherein the first step of contacting occurs by contacting the catalyst, activator system, and monomer wherein the catalyst is represented by the formula of $$X_1X_2M_1(CpCp^*)M_2X_3X_4$$

wherein:

M1 is a bridging element of silicon,

M2 is the metal center of the catalyst, and is preferably titanium, zirconium, or hafnium, Cp and Cp* are the same or different substituted or unsubstituted indenyl or tetrahydroindenyl rings that are each bonded to both $M_1$ and $M_2$, and X1, X2, X3, and X4 or are preferably independently selected from hydrogen, branched or unbranched $C_1$ to $C_{20}$ hydrocarbyl radicals, or branched or unbranched substituted $C_1$ to $C_{20}$ hydrocarbyl radicals; and the activator system is a combination of an activator and co-activator, wherein the activator is a non-coordinating anion, and the co-activator is a tri-alkylaluminum compound wherein the alkyl groups are independently selected from C1 to C20 alkyl groups, wherein the molar ratio of activator to transition metal compound is in the range of 0.1 to 10 and the molar ratio of co-activator to transition metal compound is 1 to 1000, and the catalyst, activator, co-activator, and monomer are contacted in the absence of hydrogen, at a temperature of 80° C. to 150° C., and with a reactor residence time of 2 minutes to 6 hours.

11. The engine oil composition of claim 1, wherein the second base oil component comprises a Group V base stock.

12. The engine oil composition of claim 1, wherein the second base oil component comprises an alkylated naphthalene base stock.

13. The engine oil composition of claim 1, wherein the engine oil composition is a 0W SAE monograde viscosity.

14. The engine oil composition of claim 1, wherein the engine oil composition has a kinematic viscosity at 100° C. of 5 cSt or less.

15. The engine oil composition of claim 1, wherein the engine oil composition has a CCS viscosity of less than 2500 cP at −35° C. as determined by ASTM D5293.

16. The engine oil composition of claim 1, wherein the engine oil composition has a TEOST MHT-4 deposit of less than 35 mg as determined by ASTM D7097.

17. The engine oil composition of claim 1, wherein the engine oil composition has a total base number of at least 6.0 mgKOH/g as determined by ASTM D2896.

18. The engine oil composition of claim 1, wherein the engine oil composition has an average gray value of at least 100 as determined by ASTM D6557.

19. The engine oil composition of claim 1, wherein the engine oil composition has a sulfated ash content of greater than 0.2 wt % as determined by ASTM D874.

20. The engine oil composition of claim 1, wherein the engine oil composition has a combined calcium and magnesium concentration, when one or both are present, of at least 0.05 wt % of the composition.

21. The engine oil composition of claim 1, wherein the phosphorus content of the engine oil composition is due primarily to the presence of ZDDP.

22. The engine oil composition of claim 1, wherein the polyalphaolefin base stock comprises decene trimer molecules.

23. The engine oil composition of claim 2, wherein the polyalphaolefin base stock comprises decene trimer molecules.

24. The engine oil composition of claim 3, wherein the polyalphaolefin base stock comprises decene trimer molecules.

* * * * *